US006578840B1

(12) United States Patent
Kudo

(10) Patent No.: US 6,578,840 B1
(45) **Date of Patent: *Jun. 17, 2003**

(54) SHEET CONVEYING APPARATUS

(75) Inventor: Kazuhide Kudo, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,570

(22) Filed: Nov. 4, 1998

(30) Foreign Application Priority Data

Nov. 7, 1997 (JP) ..... 9-322040

(51) Int. Cl.[7] ..... B65H 5/00

(52) U.S. Cl. ..... 271/10.13; 271/10.01; 271/10.08

(58) Field of Search ..... 271/10.01, 10.08, 271/10.13, 116, 121, 272

(56) References Cited

U.S. PATENT DOCUMENTS

| | | | | |
|---|---|---|---|---|
| 344,611 | A | * | 6/1886 | Applegate |
| 3,397,588 | A | * | 8/1968 | Johnson ..... 74/376 |
| 3,433,337 | A | * | 3/1969 | Salter ..... 192/46 |
| 3,552,492 | A | * | 1/1971 | Mullins ..... 166/237 |
| 3,563,533 | A | * | 2/1971 | Limberger ..... 271/36 |
| 4,261,452 | A | * | 4/1981 | Barrows ..... 192/42 |
| 4,387,889 | A | * | 6/1983 | Koyama et al. ..... 271/10 |
| 4,645,192 | A | * | 2/1987 | Watanabe ..... 271/9 |
| 4,807,868 | A | * | 2/1989 | Hirst et al. ..... 271/256 |
| 4,934,686 | A | * | 6/1990 | Ono et al. ..... 271/117 |
| 5,203,553 | A | * | 4/1993 | Chiang ..... 271/10 |
| 5,235,381 | A | | 8/1993 | Namiki et al. ..... 355/72 |
| 5,240,239 | A | * | 8/1993 | Kim ..... 271/10 |
| 5,253,854 | A | | 10/1993 | Tanoue et al. ..... 271/10 |
| 5,259,607 | A | * | 11/1993 | Hironori et al. ..... 271/10 |
| 5,265,857 | A | * | 11/1993 | Chiang ..... 271/10 |
| 5,624,109 | A | * | 4/1997 | Tanaka ..... 271/10.13 |
| 5,860,645 | A | * | 1/1999 | Tomura et al. ..... 271/10.13 |
| 5,863,036 | A | * | 1/1999 | Tanaka et al. ..... 271/10.11 |
| 5,873,441 | A | * | 2/1999 | Tsujishita ..... 192/46 |
| 6,024,356 | A | * | 2/2000 | Tanaka et al. ..... 271/10.13 |
| 6,099,179 | A | * | 8/2000 | Higashi et al. ..... 400/613 |
| 6,378,858 | B1 | * | 4/2002 | Suga ..... 271/10.01 |

FOREIGN PATENT DOCUMENTS

| | | | | |
|---|---|---|---|---|
| GB | 1222623 | * | 2/1971 | ..... 271/10.13 |

* cited by examiner

*Primary Examiner*—Donald P. Walsh
*Assistant Examiner*—Joseph C Rodriguez
(74) *Attorney, Agent, or Firm*—Fitzpatrick, Cella, Harper & Scinto

(57) ABSTRACT

A sheet conveying apparatus has a sheet conveying rotatable member for holding a sheet and conveying the sheet in a predetermined direction, a drive source for rotatively driving the conveying rotatable member, and a drive transmitting unit for transmitting the driving force of the drive source to the conveying rotatable member, and the drive transmitting unit has a releasing mechanism for releasing the transmission of the driving force from the drive source when the rotational force of the conveying rotatable member is transmitted from the conveying rotatable member to the drive source. A pivotally movable member rotates while abutting against a sheet cassette and a rotation of that pivotally movable member causes a first and second gear to communicate.

7 Claims, 24 Drawing Sheets

1
2
4
5
6
7
8
9
10
A
B
D
E
F
H
J
S1

SHEET CONVEYING APPARATUS

BACKGROUND OF THE INVENTION

1. Field of the Invention

This invention relates to a sheet conveying apparatus for conveying sheet materials which is applied to an image forming apparatus such as an electrophotographic apparatus, an electrostatic recording apparatus or a laser beam printer.

2. Related Background Art

As image forming apparatus of this kind, there are, for example, electrophotographic apparatuses, electrostatic recording apparatuses, laser beam printers, etc. As a first example of the prior art, an image forming apparatus using an electrophotographic process will hereinafter be described with reference to FIGS. 22 and 23 of the accompanying drawings.

In FIGS. 22 and 23, the reference numeral 201 designates an image forming apparatus, and the reference numeral 202 denotes a feeding cassette containing sheet materials S therein. The feeding cassette 202 has the sheet materials S stacked therein, and is mounted on the image forming apparatus 201 from the direction of arrow A.

A feeding roller 203 is adapted to be rotated about the center of rotation 203*a* to thereby feed the sheet materials S into the image forming apparatus 201. A conveying roller 204 is rotatably installed in the image forming apparatus 201. A pinch roller 205 is rotatably installed in the image forming apparatus 201. This pinch roller 205 is pressed by pressing means (not shown) in order to form a nip with the conveying roller 204.

The reference numerals 206, 220 and 210 respectively denote a drive input gear, an idler gear, and a conveying roller driving gear. These gears are all rotatably installed in the image forming apparatus 201 and are connected together so as to be capable of transmitting drive. The conveying roller driving gear 210 is fixed in the direction of rotation with the conveying roller 204, and by the conveying roller driving gear 210 being rotated, the conveying roller 204 can be driven.

When the drive input gear 206 is rotated in the direction of arrow E by a main motor (not shown), the conveying roller 204 is rotated in the direction of arrow H through the idler gear 220 and the conveying roller driving gear 210. By this operation, the conveying roller 204 and the pinch roller 205 function to feed the sheet material S fed by the feeding roller 203 into the image forming apparatus 201.

Register rollers 211 convey the sheet material S at predetermined timing, and a process cartridge 212 contains a photosensitive drum 212*a,* a primary charger, a developing device, a cleaning device (not shown), etc. therein. The reference numeral 213 designates a transfer roller, and the reference numeral 214 denotes a fixating device containing a fixating roller 214*a,* a pressing roller 214*b,* etc. therein. The references numeral 215, 216 and 217 respectively designate first discharge rollers, second discharge rollers, and a discharge tray on which printed sheet materials S are to be stacked. A scanner unit 218 scans a laser beam L, and a mirror 219 directs the laser beam L to the photosensitive drum 212*a.*

In the construction as described above, when the image forming apparatus 201 is instructed to effect printing by a host computer (not shown) connected thereto, the feeding roller 203 is rotated, whereby a sheet material S in the feeding cassette 202 is fed, and the fed sheet material S is conveyed into the image forming apparatus 201 by the conveying roller 214 and the pinch roller 215. The sheet material S is further directed to the process cartridge by the register rollers 211, and an image is printed on the surface of the sheet material S by a known printing process.

The sheet material S after transfer is further conveyed to the fixating device 214, where the image thereon is fixated, and then the sheet material S is discharged onto the discharge tray 217 by the first discharge rollers 215 and the second discharge rollers 216.

The prior art as described above, however, has suffered from the following problem.

In the first example of the prior art, there is a case where due to paper jam (hereinafter referred to as the "jam") or other trouble, the image forming apparatus 201 is stopped with a sheet material nipped between the conveying roller 204 and the pinch roller 205 (the position of the sheet material S1 in FIG. 22).

In such case, in the construction of the prior art, a pressing force for forming the nip is acting between the conveying roller 204 and the pinch roller 205, and the conveying roller driving gear 210 is always connected to the main motor or other driving system, so that when the sheet material S1 is to be pulled out for the treatment of the jam, it has been necessary to rotate the main motor or other driving system.

Therefore, due to the load of the main motor or other driving system, a great force has become necessary to pull out the sheet material S1, and the treatability of the jam has been bad. Also, the sheet material S1 might be broken by the operation of pulling out the sheet material S1, and the broken sheet material S1 might remain in the image forming apparatus 201 to hinder the conveyance of the sheet materials S.

(Second Example of the Prior Art)

FIGS. 24 and 25 of the accompanying drawings show a second example of the prior art.

In FIGS. 24 and 25, portions common to those in the first example of the prior art are designated by reference numerals corresponding to those in the first example.

A feed roller 325 and a retard roller 326 form the nip therebetween, and the feed roller 325 is rotated in the direction of arrow V by driving means (not shown). The retard roller 326 is connected to a retard roller driving gear 328 through a torque limiter 327. The retard roller driving gear 328 is connected to an idler gear 320 so as to be capable of transmitting drive.

Accordingly, when the idler gear 320 is rotated in the direction of arrow F, the retard roller driving gear 328 is rotated in the direction of arrow R, whereby the drive force in the direction of arrow R is given to the retard roller 326 through the torque limiter 327. When predetermined or greater torque in the direction of arrow W is given to the retard roller 326, slip occurs in the interior of the torque limiter 327, so that the retard roller 326 is rotated in the direction of arrow W against the driving force of the retard roller driving gear 328 in the direction of arrow R.

By such construction, when a plurality of sheet materials S come into the nip portion between the feed roller 325 and the retard roller 326, only the uppermost sheet material S is conveyed.

During image formation, when the image forming apparatus 301 is instructed to effect printing by a host computer (not shown) connected thereto, a paper feeding roller 303 is rotated, to feed a sheet material S in a paper feeding cassette 302. When a plurality of sheet materials S are fed, only the uppermost sheet material S is conveyed into the image forming apparatus 301 by the feed roller 325 and the retard roller 326. An image is formed on the conveyed sheet material S, which is then discharged onto a discharge tray 317.

Again in the second example of the prior art, there is a case where when the image forming apparatus 301 is stopped due to jam or other trouble, a sheet material S1 is at the nip between the conveying roller 304 and the pinch roller 305 and at the nip between the feed roller 325 and the retard roller 326, as shown in FIGS. 24 and 25.

However, when the sheet material S1 is to be pulled out in the direction of arrow J when the jam has occurred, a pressing force for forming the nip is acting between the conveying roller 304 and the pinch roller 305, and between the feed roller 325 and the retard roller 326. Therefore, by the force with which the sheet material S1 is pulled out, drive force in the direction of arrow H acts on the conveying roller driving gear 310, so that a driving force in the direction of arrow F acts on the idler gear 320, and a driving force in the direction of arrow R acts on the retard roller driving gear 328. On the other hand, since the sheet material S1 is located at the nip between the feed roller 325 and the retard roller 326, a driving force in the direction of arrow W is given to the retard roller 326 by the force with which the sheet material S1 is pulled out.

Accordingly, the opposite driving forces in the direction of arrows R and W are given to the retard roller 326 by the operation of pulling out the sheet material S1 in the direction of arrow J, torque enough to cause slip in the interior of the torque limiter 327 becomes necessary. As the result, a great force becomes necessary to pull out the sheet material S1, which leads to the disadvantages that the treatability of the jam is bad, and the sheet material S1 is broken. Thus, the broken sheet material S remains in the image forming apparatus 301 and hinders the conveyance of the sheet materials S.

SUMMARY OF THE INVENTION

The present invention has been made in order to solve the above-noted problems peculiar to the first and second examples of the prior art, and has an object thereof to provide a sheet material conveying apparatus and an image forming apparatus, in which a load for pulling out a sheet material is reduced to thereby improve the treatability of jam and which is excellent in working property.

To achieve the above object, in the sheet material conveying apparatus provided with conveying means for conveying a sheet material while holding it by a driving force transmitted from a drive source, it is characterized by the drive transmission releasing mechanism for releasing the transmission of drive force to a drive source when the driving force is imparted from the conveying means. When the apparatus is stopped with the sheet material held by the conveying means and to be pulled out, the transmission of the drive to the drive force source is released by the drive transmission releasing mechanism. Therefore, the load for pulling out the sheet material is reduced.

The drive transmission releasing mechanism has a first gear provided on the drive source side and a second gear provided on the conveying means side, and when the first gear is rotated, it is connected to the second gear and the rotational force thereto, and when the second gear is rotated, it is not connected to the first gear not to transmit the rotational force thereto.

Further, the apparatus is provided with biasing means for biasing the first gear and the second gear toward each other, each of which are provided with projections having engagement surfaces engaged with each other and slide surfaces sliding respectively. With this feature, when the first gear is rotated in a predetermined direction, the engagement surfaces of the projections come into engagement with each other to connect the first gear with the second gear, and when the second gear is rotated in a predetermined direction. the slide surfaces of the projections slide relative to each other to move the second gear away from the first gear against the biasing force of the biasing means, and the first gear and the second gear are not connected together.

Also, in the sheet material conveying apparatus provided with a sheet cassette containing sheet materials therein, and conveying means for conveying the sheet materials fed from the sheet cassette by a driving force transmitted from a drive source while holding the sheet materials, it is possible to provide a drive transmitting mechanism for transmitting the driving force between the drive source and the conveying means only when the sheet cassette is set at a predetermined position. When the apparatus is stopped with a sheet material held by the conveying means and to be pulled out, if the sheet cassette is moved from the predetermined position, the driving force is not transmitted between the drive source and the conveying means. Therefore, the load for pulling out the sheet material is reduced.

Further, the present invention also has an object to obtain the above-described operational effect in a sheet feeding device in which a torque limiter is interposed between a retard roller opposed to a feed roller and a driving gear therefor.

DESCRIPTION OF THE PREFERRED EMBODIMENTS

Some preferred embodiments of this invention will hereinafter be described in detail by way of example. However, the dimensions, materials, shapes, relative disposition, etc. of constituent members described in these embodiments, unless particularly specified, are not restrictive.

A sheet material conveying apparatus and an image forming apparatus according to a first embodiment of the present invention will hereinafter be described with reference to FIGS. 1 to 7.

Figure 1:
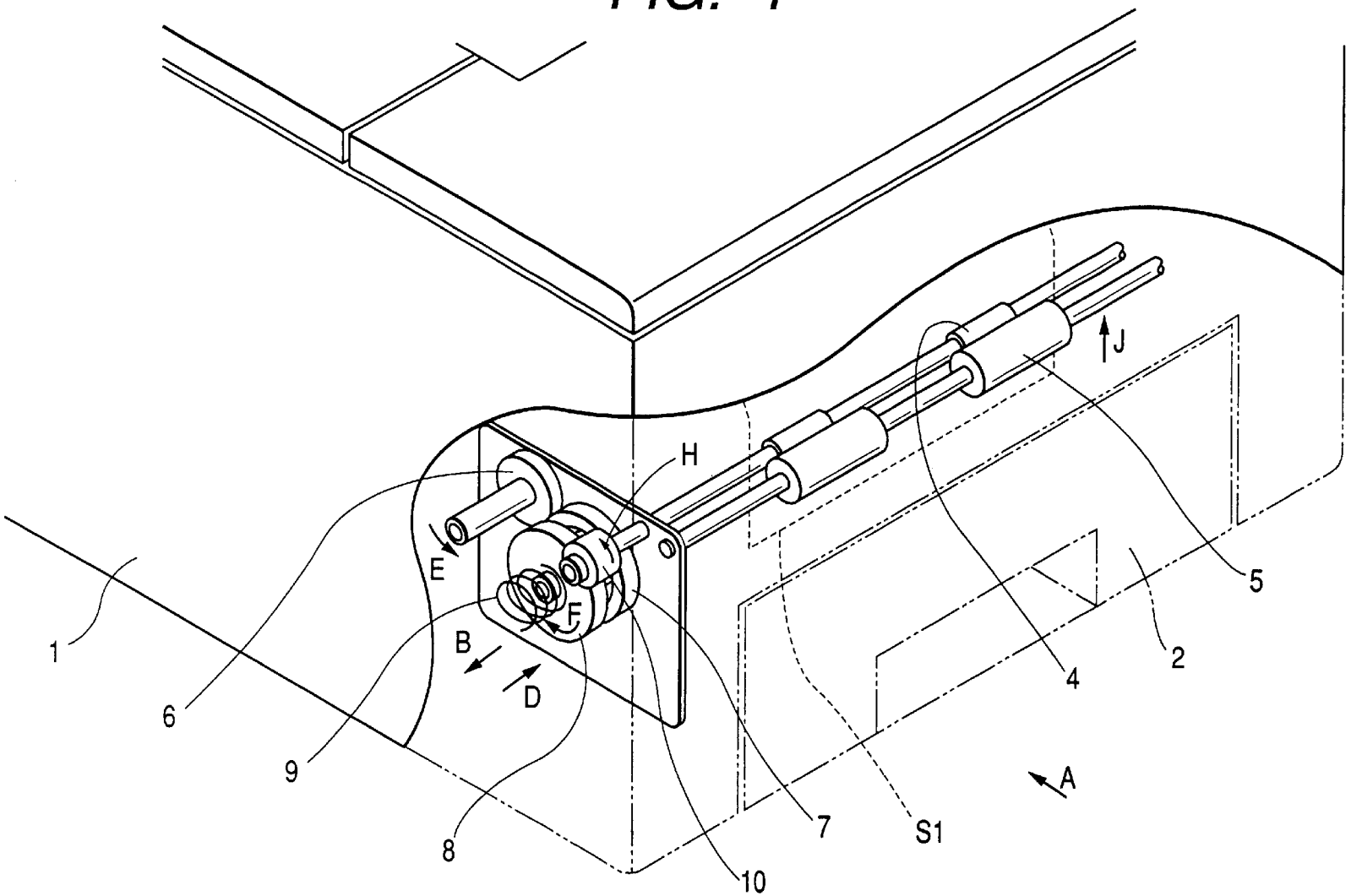
FIG. 1 is a fragmentary perspective view of an image forming apparatus provided with a sheet material conveying apparatus according to a first embodiment of the present invention.

In FIG. 1, a feeding cassette 2 (sheet cassette) containing sheet materials S therein is mounted on an image forming apparatus 1 from the direction of arrow A.

A feeding roller 3 is rotated about the center of rotation 3*a* to thereby feed the sheet materials S into the image forming apparatus 1. A conveying roller 4 is rotatably installed in the image forming apparatus 1. A pinch roller 5 is rotatably installed in the image forming apparatus 1, and is pressed by pressing means (not shown) to form a nip with the conveying roller 4. The conveying roller 4 and the pinch roller 5 together constitute conveying means.

Figure 3:
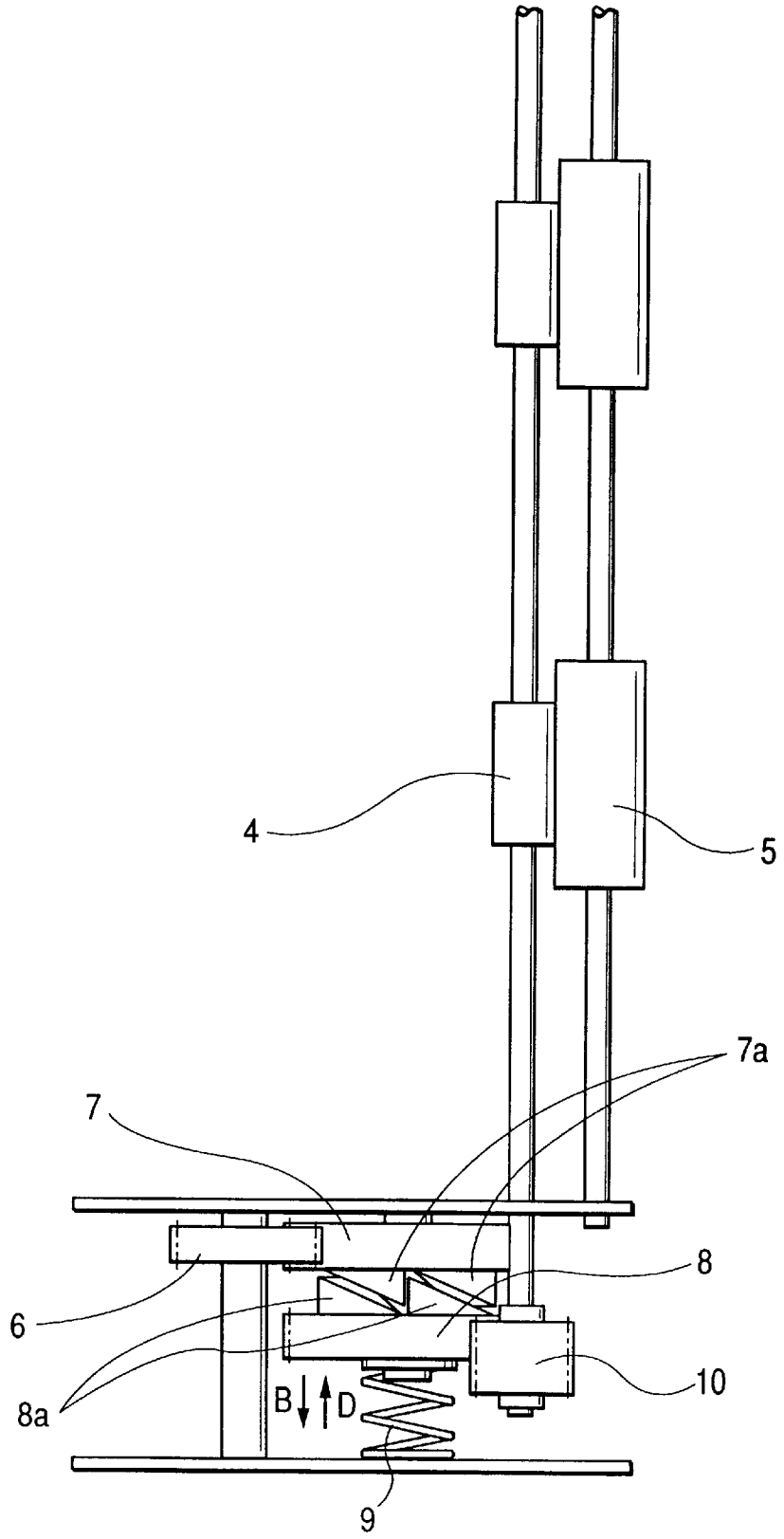
FIG. 3 is an illustration of the essential portions of the sheet material conveying apparatus according to the first embodiment.
Figure 4:
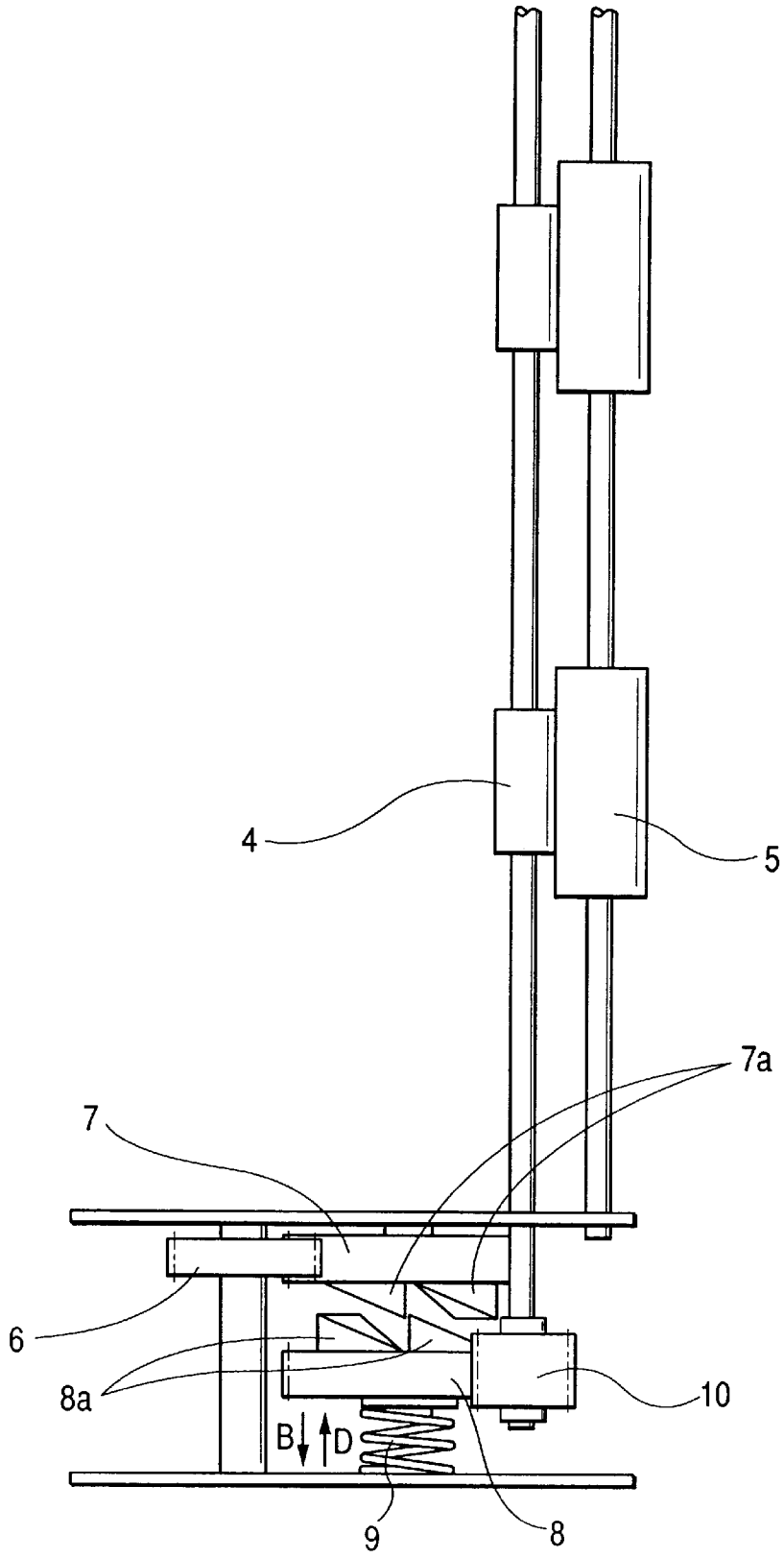
FIGS. 4, 5, 6 and 7 are illustrations of the essential portions of the same sheet material conveying apparatus.
Figure 5:
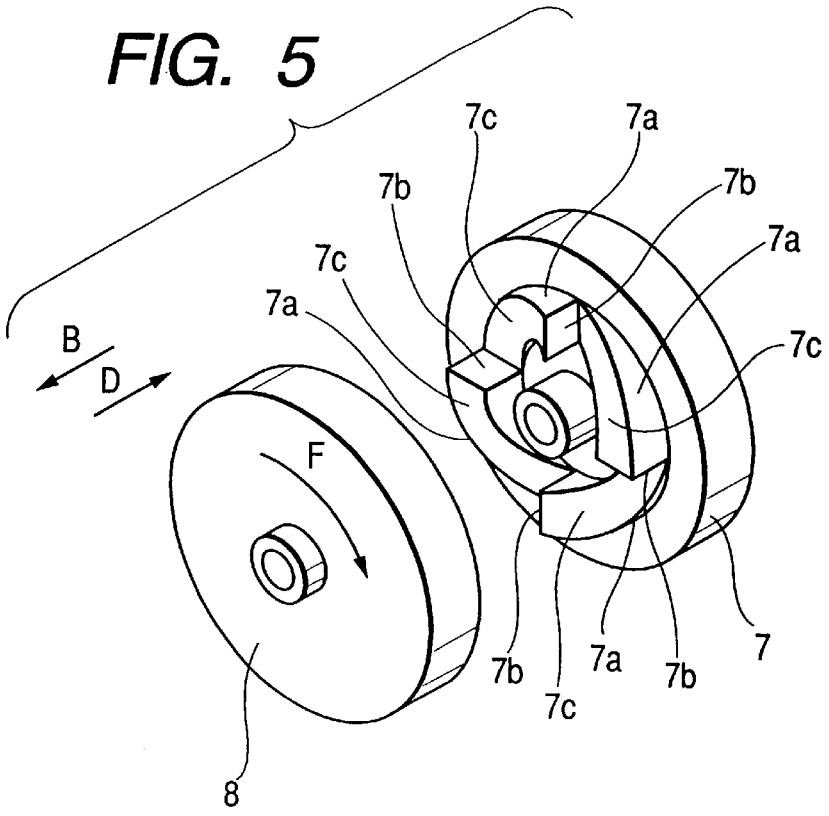

A drive input gear 6 and an input gear 7 (first gear) are both rotatably installed in the image forming apparatus 1. The input gear 7, as shown in FIGS. 3 to 5, has cam members 7*a* (one or more projections) on the side surface thereof, each of which is provided with a flat surface (engagement surface) 7*b* and an inclined surface (slide surface) 7*c*.

Figure 6:
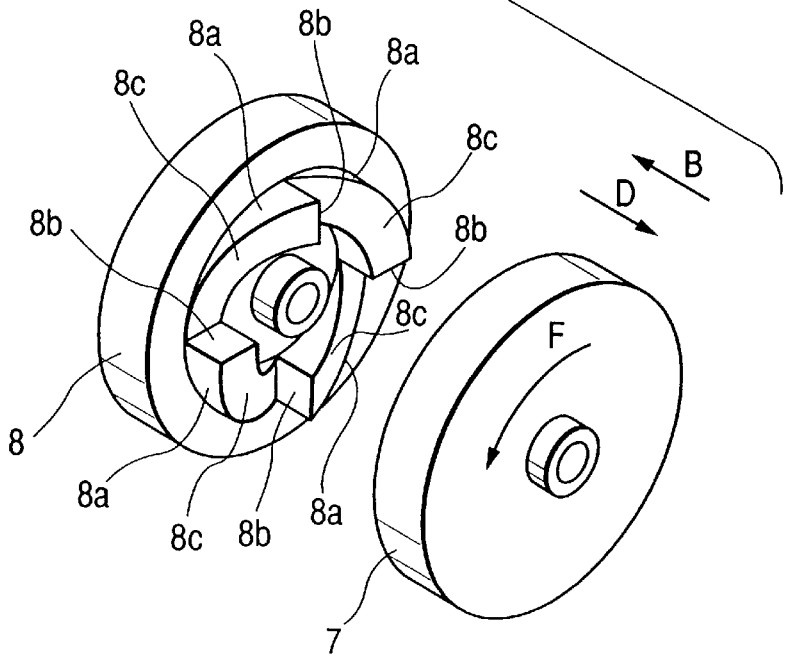

An output gear 8 (second gear) is installed coaxially with the input gear 7 in the image forming apparatus 1 for pivotal movement and rotation in the directions of arrows B and D. This output gear 8, as shown in FIGS. 3, 4 and 6, has cam members 8*a* (one or more projections) on a side surface thereof each of which, like the cam members 7*a* of the input gear 7, is provided with a flat surface (engagement surface) 8*b* and an inclined surface (slide surface) 8*c*.

Biasing means 9 biases the output gear 8 in the direction of arrow D. By this biasing force, the output gear 8 is usually disposed at a position whereat the inclined surface 8*c* these of and the inclined surface 7*c* of the input gear 7 are in contact with each other, as shown in FIG. 3.

A conveying roller driving gear 10 is installed in the image forming apparatus 1 rotatively in the rotation direction of the conveying roller 4. It is constructed that when the conveying roller driving gear 10 is rotated, the conveying roller 4 is also rotated with the conveying roller driving gear 10.

The drive input gear 6 and the input gear 7, and the output gear 8 and the conveying roller driving gear 10 are connected together, respectively, so as to be capable of transmitting the drive.

The operation when the drive input gear 6 is driven in the direction of arrow E by a main motor (drive source) will be explained.

When the drive input gear 6 is rotated in the direction of arrow E in FIG. 1, the input gear 7 receives a driving force in the direction of arrow F (in FIG. 7, the direction of arrow G) and the flat surface 7*b* of the input gear 7 pushes the flat surface 8*b* of the output gear 8, so that the output gear 8 receives a driving force in the direction of arrow F in FIG. 1 (in FIG. 7, the direction of arrow G) and is rotated in the direction of arrow F. Thereby, the conveying roller driving gear 10 is rotated in the direction of arrow H in FIG. 1, and the conveying roller 4 is rotated in the direction of arrow H.

Figure 2:
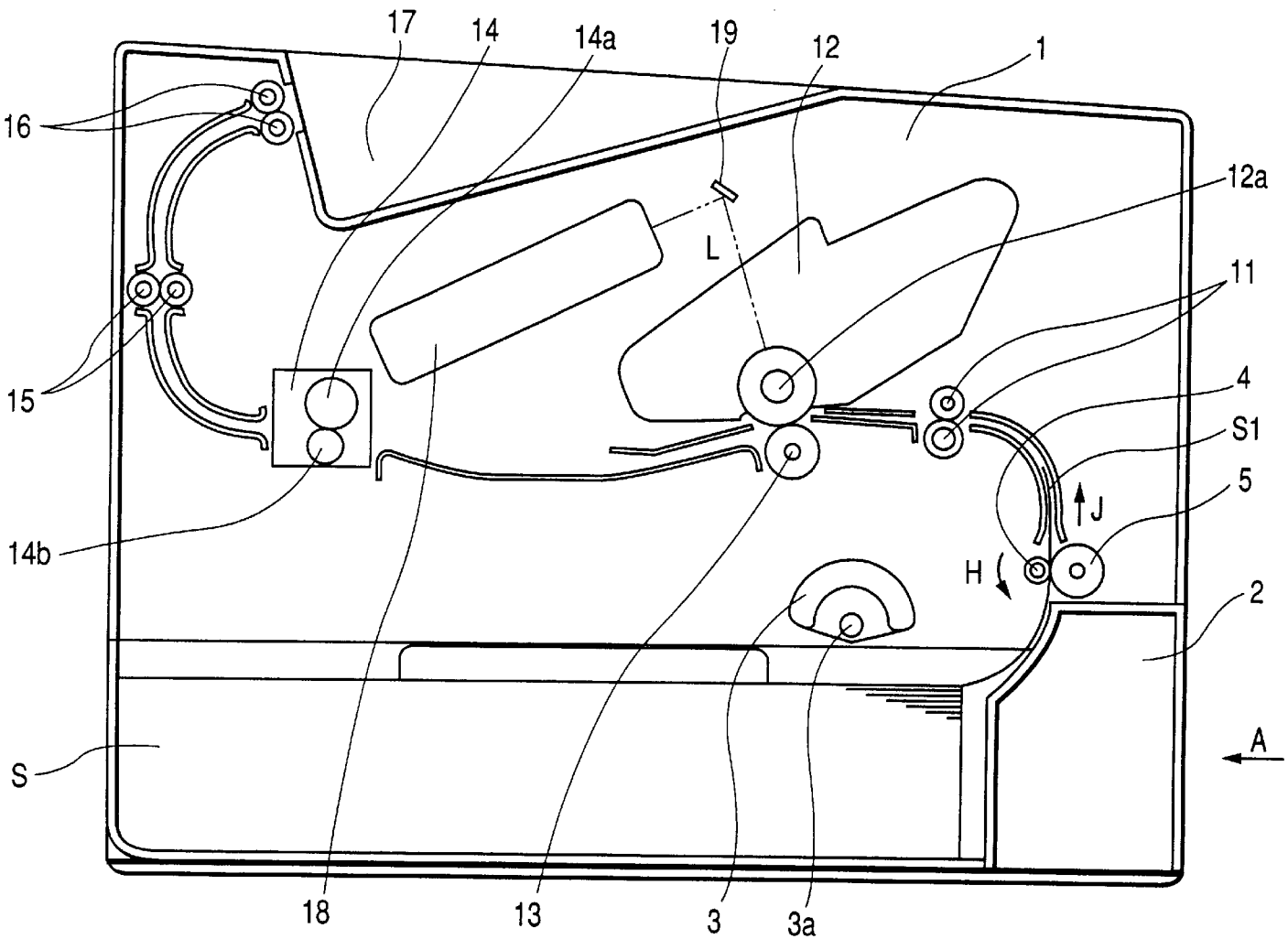
FIG. 2 is a schematic cross-sectional view of the image forming apparatus of FIG. 1.

In FIG. 2, etc., register rollers 11 convey the sheet materials S at predetermined timing, and a process cartridge 12 constituting image forming means. This cartridge 12 contains a photosensitive drum 12*a*, a primary charger, a developing device, a cleaning device (not shown), etc. therein. The reference numeral 13 designates a transfer roller, and the reference numeral 14 denotes a fixating device containing a fixating roller 14*a*, a pressing roller 14*b*, etc. therein. The reference numerals 15, 16 and 17 respectively designate first discharge rollers, second discharge rollers and a discharge tray on which printed sheet materials S are piled. A scanner unit 18 scans a laser beam L, and a mirror 19 directs the laser beam L to the photosensitive drum 12*a*.

In the construction as described above, when the image forming apparatus 1 is instructed to effect printing by a host computer (not shown) connected thereto, the feeding roller 3 is rotated and feeds a sheet material S in the feeding cassette 2.

At this time, the drive input gear 6 is rotated in the direction of arrow E by a main motor (not shown) and as described above, the conveying roller 4 is rotated in the direction of arrow H. Therefore, the sheet material S fed by the feeding roller 3 is conveyed into the image forming apparatus 1 by the conveying roller 4 and the pinch roller 5, and is further directed to the photosensitive drum 12*a* by the register rollers 11. Thus, an image is printed on the surface of the sheet material S by a known printing process.

After the transfer, the sheet material S is further conveyed to the fixating device 14 to fixate the image there on, which is then discharged onto the discharge tray 17 by the first discharge rollers 15 and the second discharge rollers 16.

In the present apparatus, there is conceivable a case where due to jam or other trouble, the image forming apparatus 1 is stopped with a sheet material being at the nip between the conveying roller 4 and the pinch roller 5 (the position of the sheet material S in FIGS. 1 and 2). At this time, it is necessary for a user to perform the work of pulling out the sheet material S1 in the direction of arrow J to deal with the jam.

In response to this pulling-out work, the conveying roller 4 receives a rotational force in the direction of arrow H, and therefore the conveying roller driving gear 10 also receives a rotational force in the direction of arrow H. By this rotational force, the output gear 8 receives a force in the direction of arrow F in FIGS. 1 and 5 (in FIG. 7, the direction of arrow G).

Figure 7:
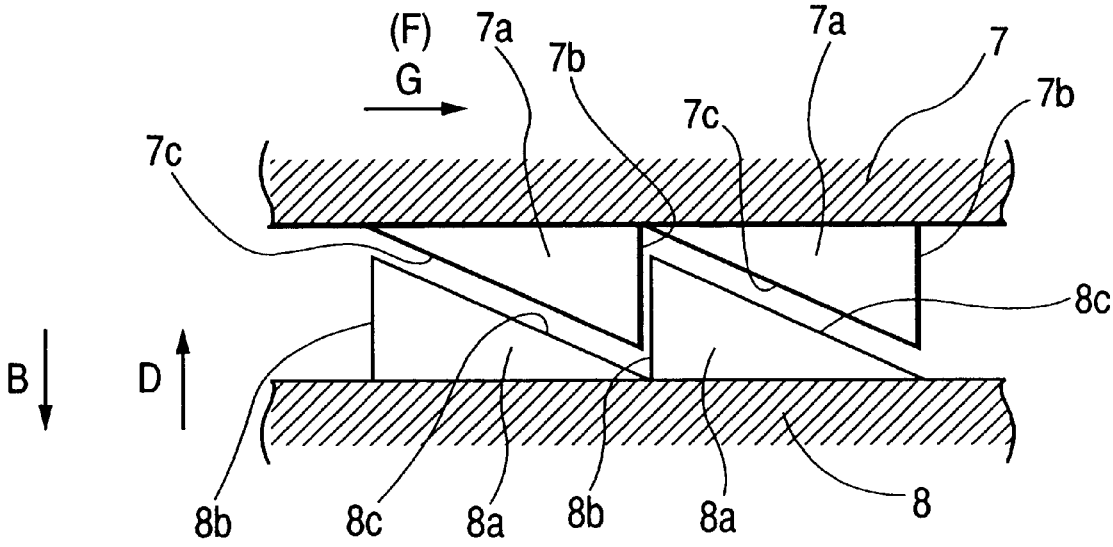

At this time, the input gear 7 is connected to the main motor or other driving system, and therefore is not rotated, and as shown in FIG. 7, the inclined surface 8*c* of the output gear 8 receives a force in the direction of arrow B from the inclined surface 7*c* of the input gear 7.

By this force, the output gear 8, as shown in FIG. 4, is moved sideways to the position indicated in FIG. 4 against the biasing force of the biasing means 9, and the cam members 8*a* thereof ride across the vertexes of the cam members 7*a* of the input gear 7 and the output gear 8 is rotated in the direction of arrow F.

As described above, projections (cam members) are provided on each of the two gears opposed to each other to thereby release the transmission of the drive from the conveying means to the drive source. Therefore, with the input gear 7 remaining fixed, the output gear 8 becomes rotatable in the direction of arrow F by the pulling-out force for the sheet material S1 so that the sheet material S1 can be pulled out with a small pulling-out force without receiving the force of the main motor or other driving system. Thus, the treatability of the jam of the sheet material remaining in the main body of the image forming apparatus 1 is improved and the sheet material can be reliably removed, and therefore any trouble in conveyance due to the sheet material remaining in the image forming apparatus 1 after the treatment of the jam can be prevented.

FIGS. 8 to 11 show a second embodiment of the present invention. In this embodiment 2, there is shown a construction in which two gears are connected together and disconnected from each other by the setting and the release of the setting of the sheet cassette to thereby release the transmission of the drive from the conveying means side to the drive source side. In the other points, the construction and action of the second embodiment are the same as those of the first embodiment, and therefore the same constituent portions are given the same reference numerals and need not be described.

Figure 10:
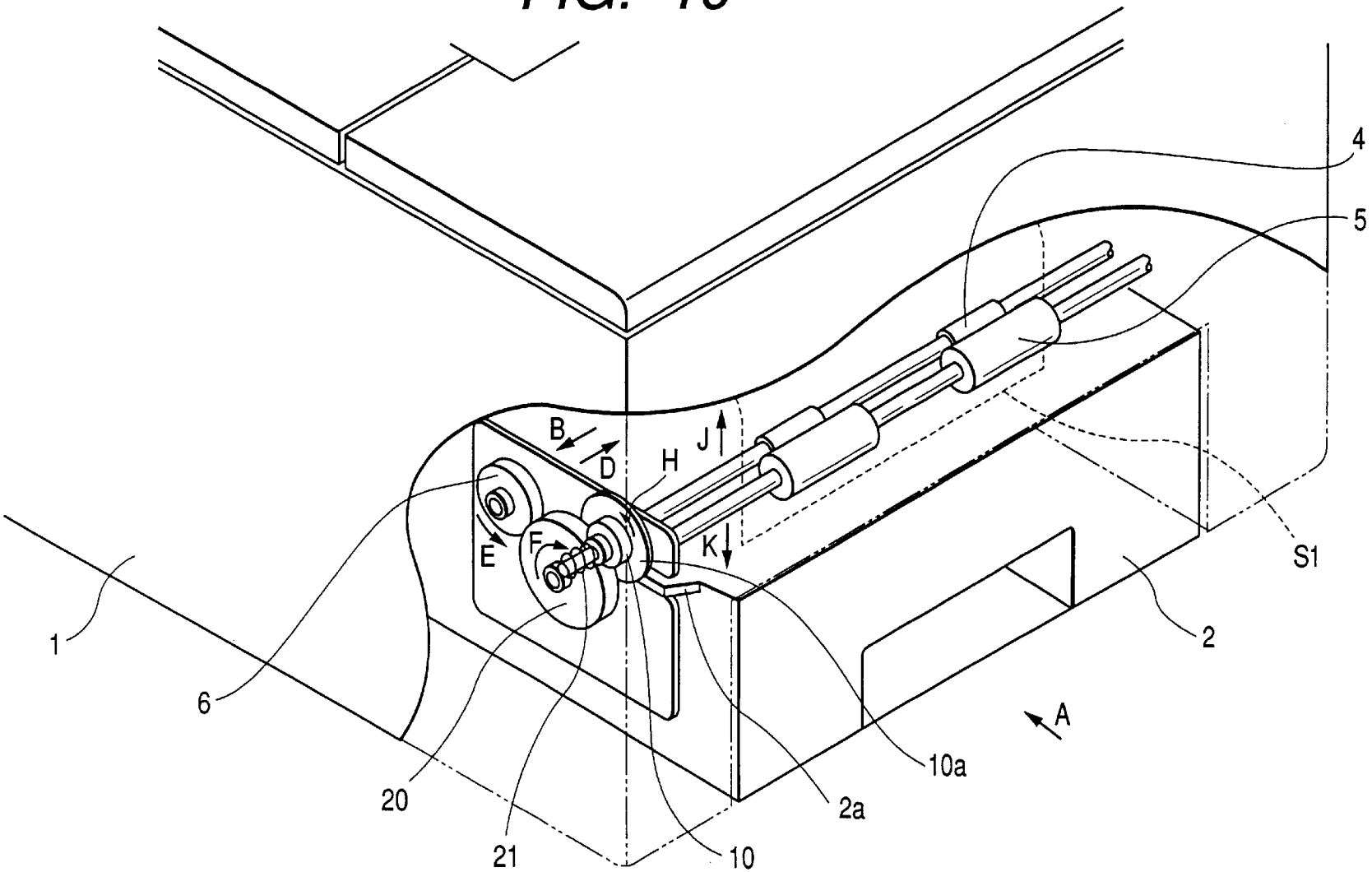
FIG. 10 is a fragmentary perspective view of the image forming apparatus provided with the sheet material conveying apparatus according to the second embodiment.

In FIG. 10, a feeding cassette 2 is provided with a projected portion 2*a* on a side thereof. A conveying roller driving gear 10 (second gear) is supported for oscillation in the directions of arrows B and D and is provided with a flange 10*a*.

An idler gear 20 (first gear) is rotatably installed in the image forming apparatus 1 and is connected to a drive input gear 6 to transmit drive force.

Figure 8:
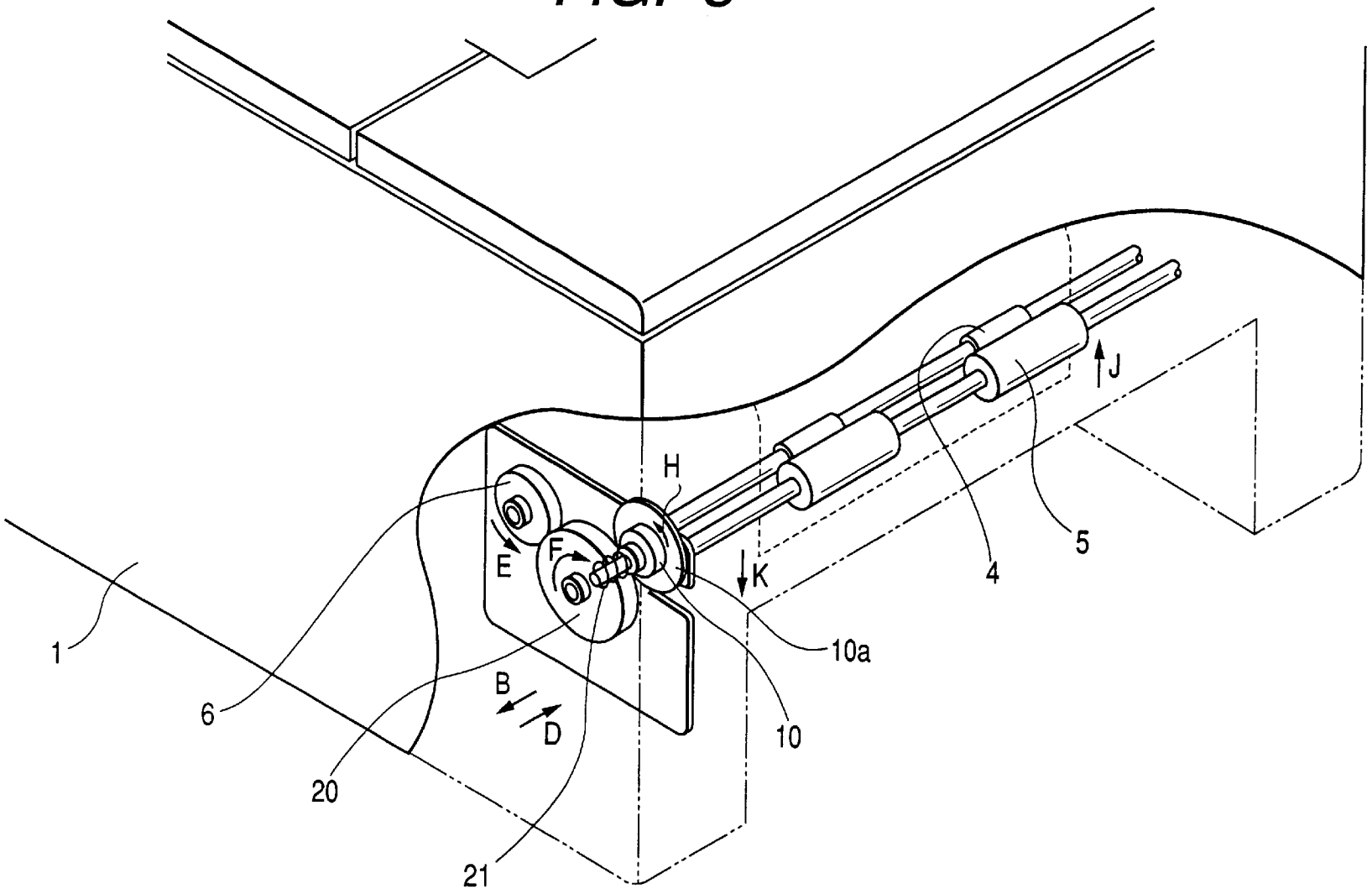
FIG. 8 is a fragmentary perspective view of an image forming apparatus provided with a sheet material conveying apparatus according to a second embodiment of the present invention.
Figure 9:
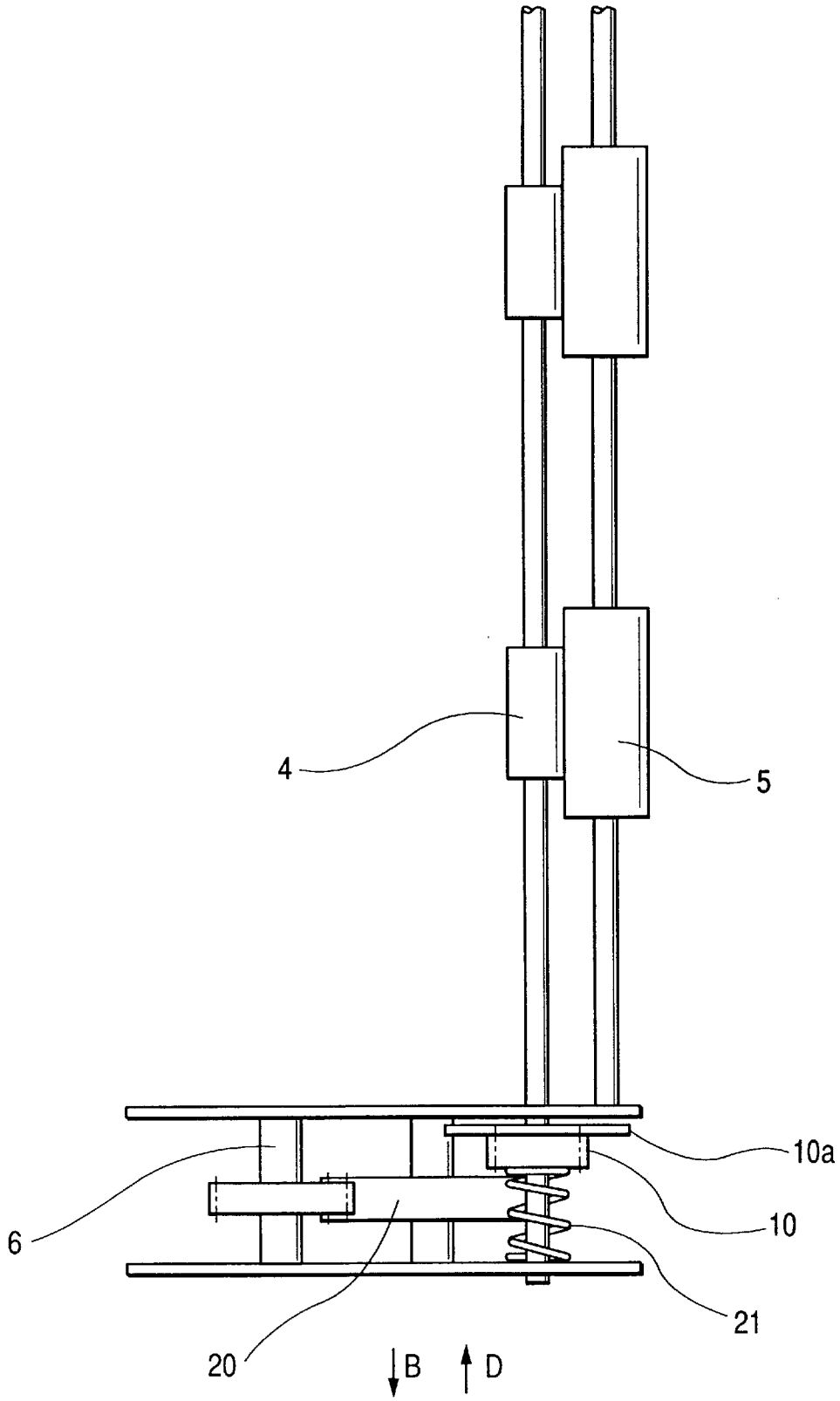
FIG. 9 is an illustration of the essential portions of the sheet material conveying apparatus according to the second embodiment.

Biasing means 21 biases the conveying roller driving gear 10 in the direction of arrow D and by this biasing force, which holds the conveying roller driving gear 10 in a position shown in FIGS. 8 and 9 in a normal state (a state in which the feeding cassette 2 is not mounted). In this position, the gear 10 is not connected to the idler gear 20.

Figure 11:
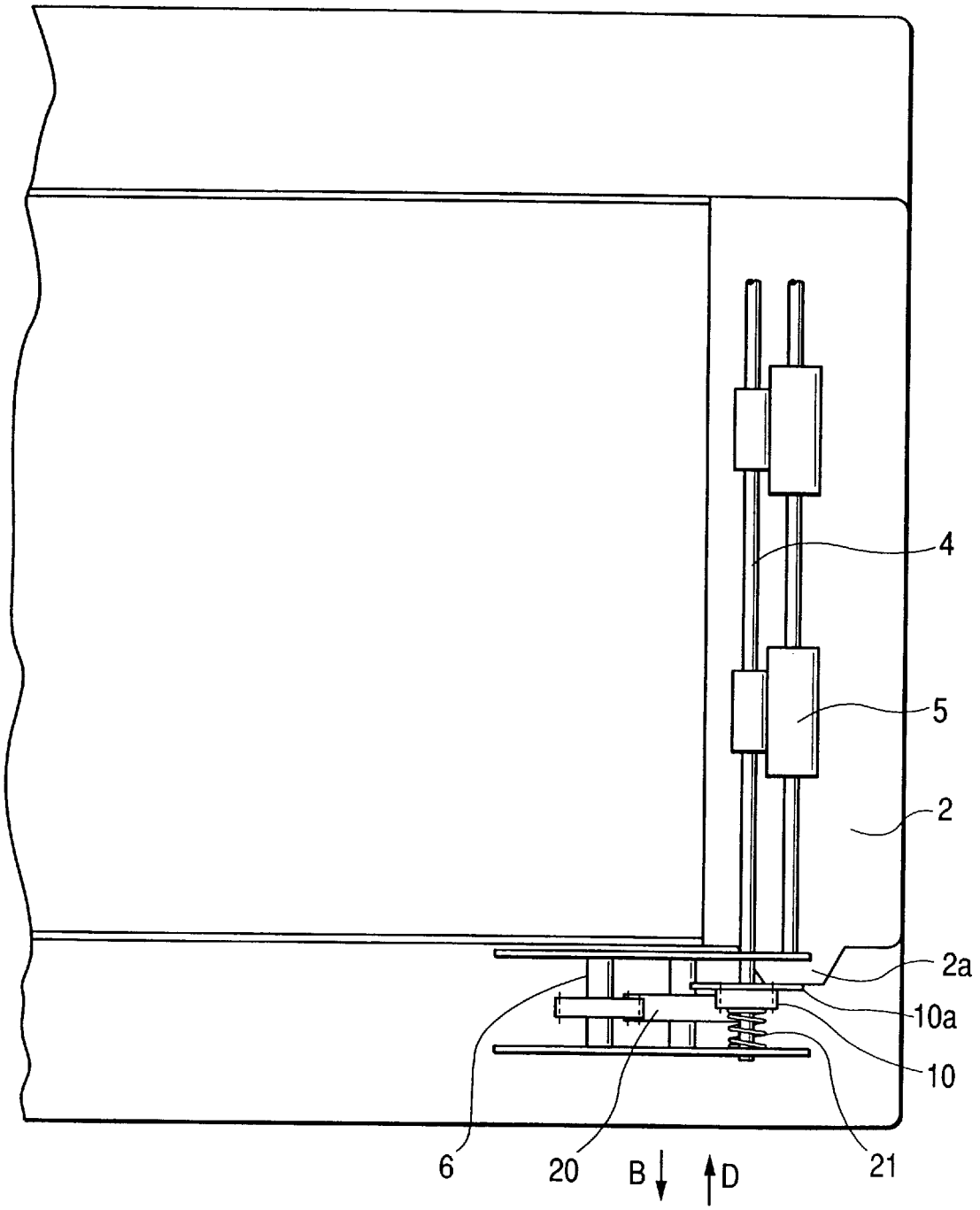
FIG. 11 is an illustration of the essential portions of the sheet material conveying apparatus according to the second embodiment.

In such a construction, when the feeding cassette 2 is inserted into the image forming apparatus 1, the projected portion 2*a* of the feeding cassette 2 pushes the flange 10*a* of the conveying roller driving gear 10, which is thus moved sideways to the position shown in FIGS. 10 and 11 against the biasing force of the biasing means 21 to be connected to the idler gear 20.

Here, when the drive input gear 6 is driven in the direction of arrow E by a main motor (not shown), the idler gear 20 is rotated in the direction of arrow F, whereby the conveying roller driving gear 10 and the conveying roller 4 are respectively rotated in the direction of arrow H.

When the image forming apparatus 1 is stopped with a sheet material being at the nip between the conveying roller 4 and the pinch roller 5 (the position of the sheet material S1 in FIG. 8) due to jam or other trouble, it is necessary for the user to pull out the sheet material S1 to deal with the jam. Prior to that, the user pulls the feeding cassette 2 out of the image forming apparatus 1. Thereby, the projected portion 2*a* of the feeding cassette 2 is separated from the flange 10*a* of the conveying roller driving gear 10, which is thus moved in the direction of arrow D to the position shown in FIGS. 8 and 9 by the biasing means 21.

In this state, since the conveying roller driving gear 10 is disconnected from the main motor or other driving system, the conveying roller 4 is rotatable by a small force. Thus, it becomes possible for the user to pull out the sheet material S1 in the direction of arrow J or the direction of arrow K with a small pulling-out force. By the projection provided on the sheet cassette directly moving the gear as described above, the treatability of the jam of the sheet material remaining in the body of the image forming apparatus 1 is improved, and the sheet material can be reliably removed. Therefore, any trouble in sheet conveyance due to the sheet material remaining in the image forming apparatus 1 after the treatment of the jam can be prevented.

FIGS. 12 to 16 show a third embodiment of the present invention, in which a projection provided on the sheet cassette indirectly moves a gear through an oscillatory member or the like.

In the other points, the construction and operation of the present embodiment are the same as those of the second embodiment, so the same constituent portions are given the same reference numerals and need not be described.

In FIGS. 12 to 16, a feeding cassette 2 is provided with a projected portion 2*a* on a side thereof. An input gear 8 has cam members 8*a* and is provided with a flange 8*d*.

Also, a first lever 22 (pivotally movable member) is installed in an image forming apparatus 1 for rotation in the direction of arrow M and the direction of arrow N about a center of rotation 22*a*, and it is provided with a first arm portion 22*b*, a second arm portion 22*c* and a hook portion 22*d*. A second lever 23 (pivotally movable member) is installed in the image forming apparatus 1 for rotation in the direction of arrow P and the direction of arrow Q about a center of rotation 23*a*, and it is provided with a first arm portion 23*b* and a second arm portion 23*c*. Biasing means 24 is in engagement with the hook portion 22*d* of the first lever 22 and biases the first lever 22 in the direction of arrow M.

Figure 12:
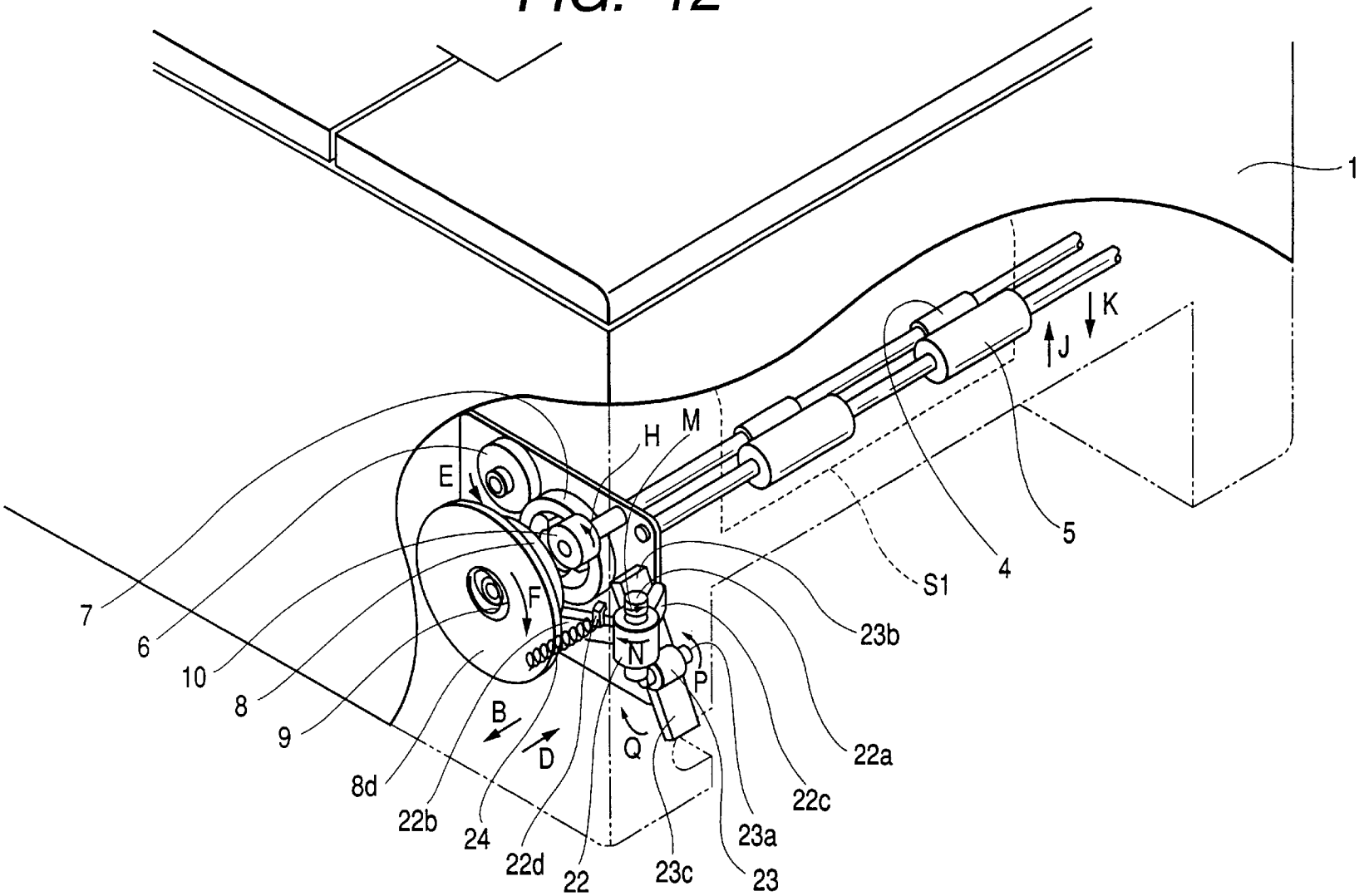
FIG. 12 is a fragmentary perspective view of an image forming apparatus provided with a sheet material conveying apparatus according to a third embodiment of the present invention.
Figure 13:
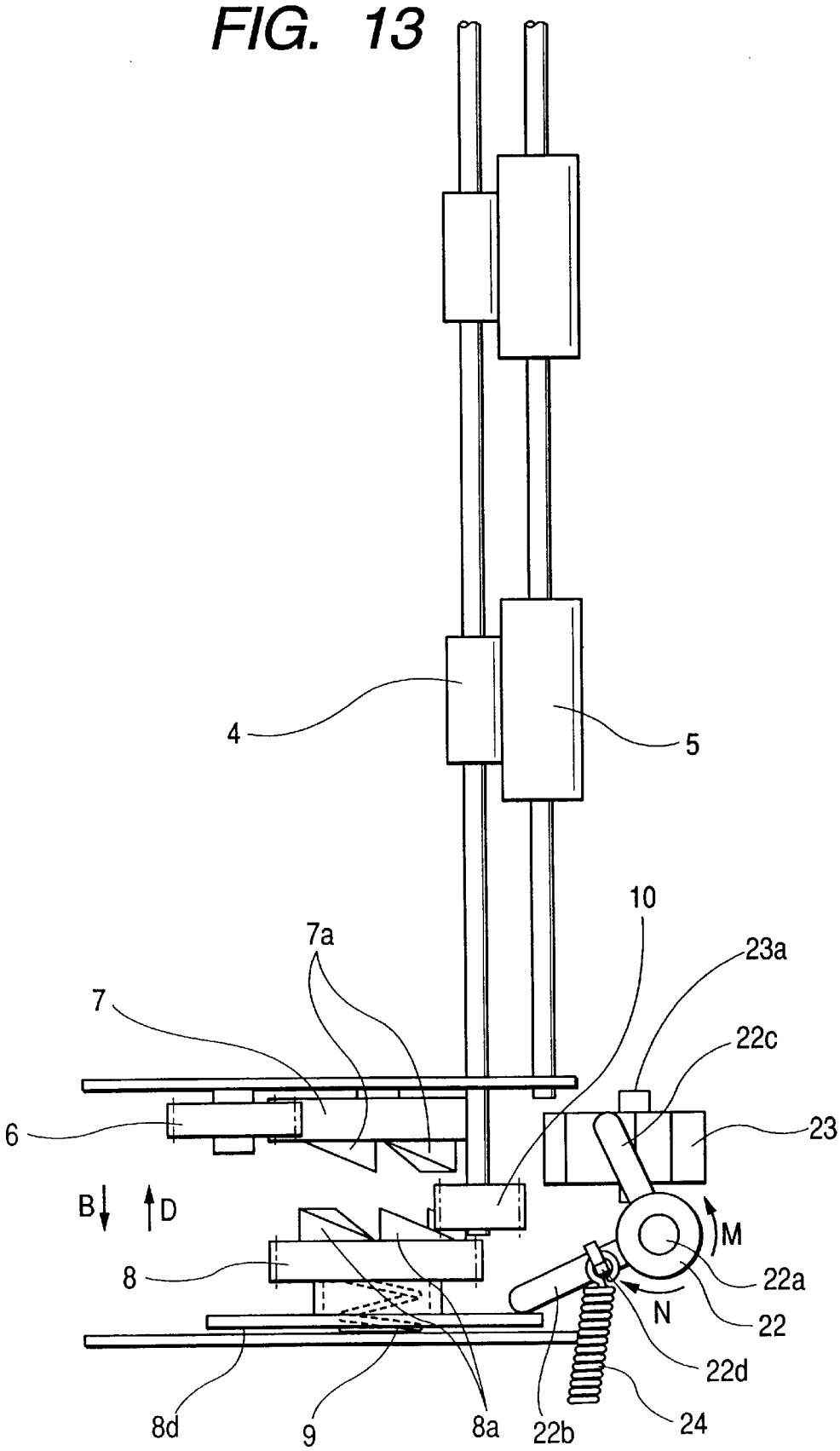
FIG. 13 is an illustration of the essential portions of the sheet material conveying apparatus according to the third embodiment.

Here, by the biasing force of the biasing means 24 for the first lever 22 in the direction of arrow M, the first arm portion 22*b* of the first lever 22 biases the flange 8*d* of the output gear 8 in the direction of arrow B. This biasing force is set to a value greater than the biasing force of the biasing means 9 for the output gear 8 in the direction of arrow D. In a normal state (in which the feeding cassette 2 is not mounted), the output gear 8 is in a position as shown in FIGS. 12 and 13 wherein the tip ends of the cam members 7*a* of the input gear 7 and the tip ends of the cam members 8*a* of the output gear 8 are separate from each other, and the input gear 7 is adapted not to contact with the output gear 8 even if the former is rotated.

Next, when the feeding cassette 2 is inserted into the image forming apparatus 1 in the direction of arrow A, the projected portion 2*a* of the feeding cassette 2 pushes the second arm portion 23*c* of the second lever 23 which is rotated in the direction of arrow Q. Thus, the second arm portion 22*c* is pushed by the first arm portion 23*b*, and the first lever 22 is rotated in the direction of arrow N against the biasing force of the biasing means 24.

Figure 14:
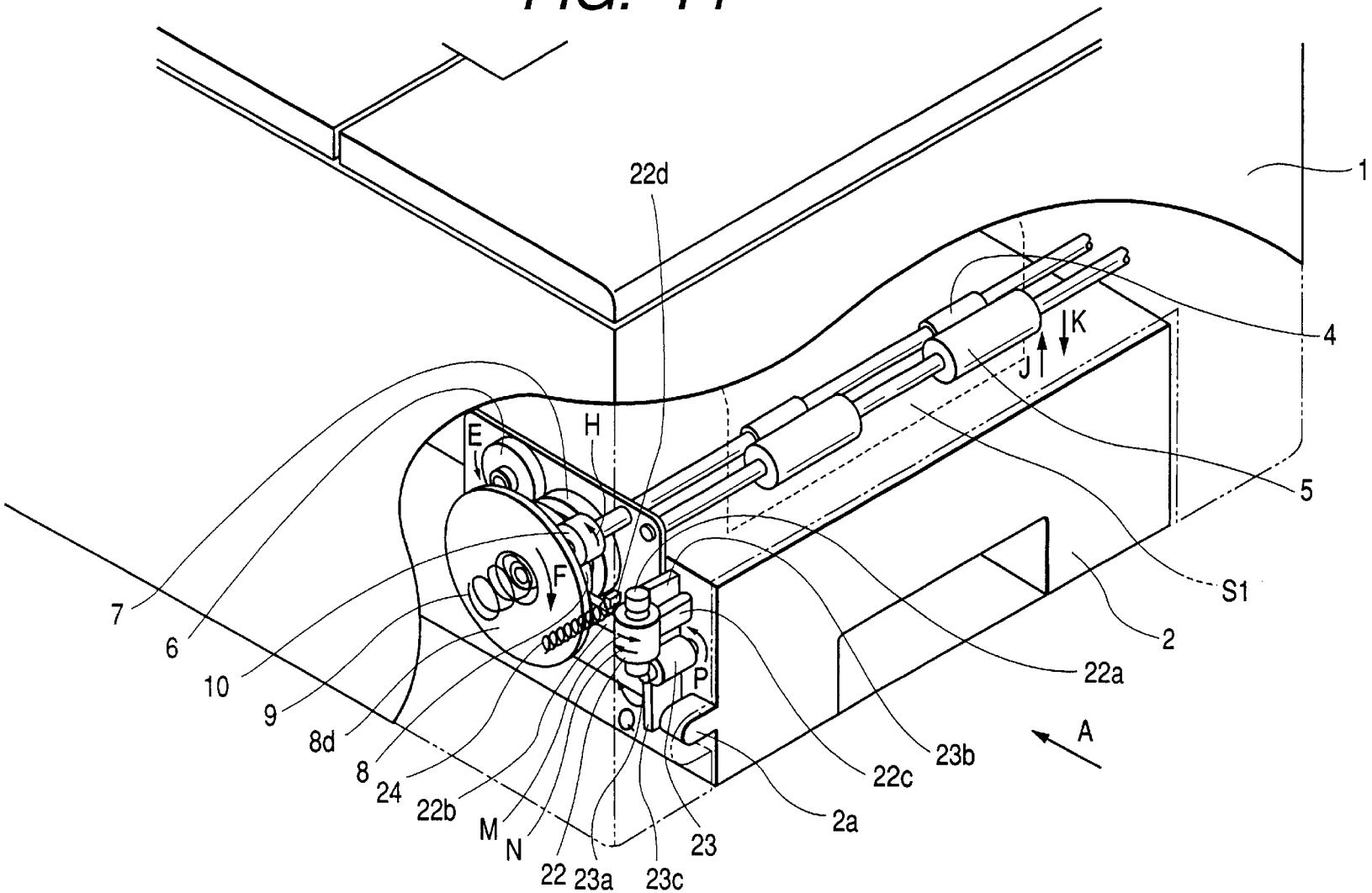
FIG. 14 is a fragmentary perspective view of the image forming apparatus provided with the sheet material conveying apparatus according to the third embodiment.
Figure 15:
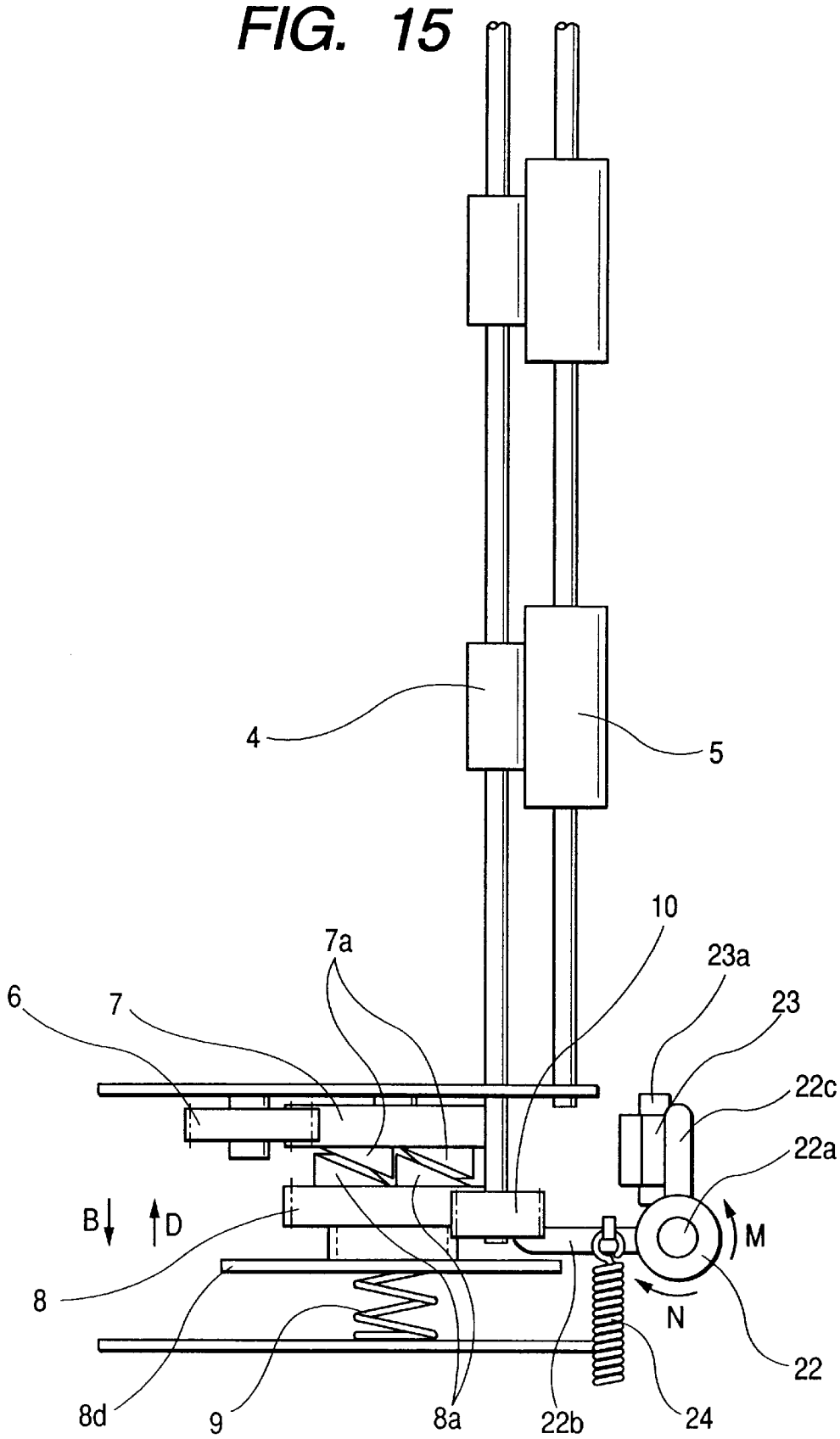
FIGS. 15 and 16 are illustrations of the essential portions of the sheet material conveying apparatus according to the third embodiment of the present invention.

In this manner, the first arm portion 22*b* of the first lever 22 releases the pushing of the flange 8*d* of the output gear 8, so that the output gear 8 is disposed at a position to be connected to the input gear 7 as shown in FIGS. 14 and 15 by the biasing force of the biasing means 9, to transmit the drive force.

When the image forming apparatus 1 is stopped with a sheet material being at the nip between the conveying roller 4 and the pinch roller 5 (the position of the sheet material S1 in FIG. 12) due to jam or other trouble, it is necessary to pull out the sheet material to deal with the jam. In the present embodiment 3, the jam can be dealt with in the following two ways.

Figure 16:
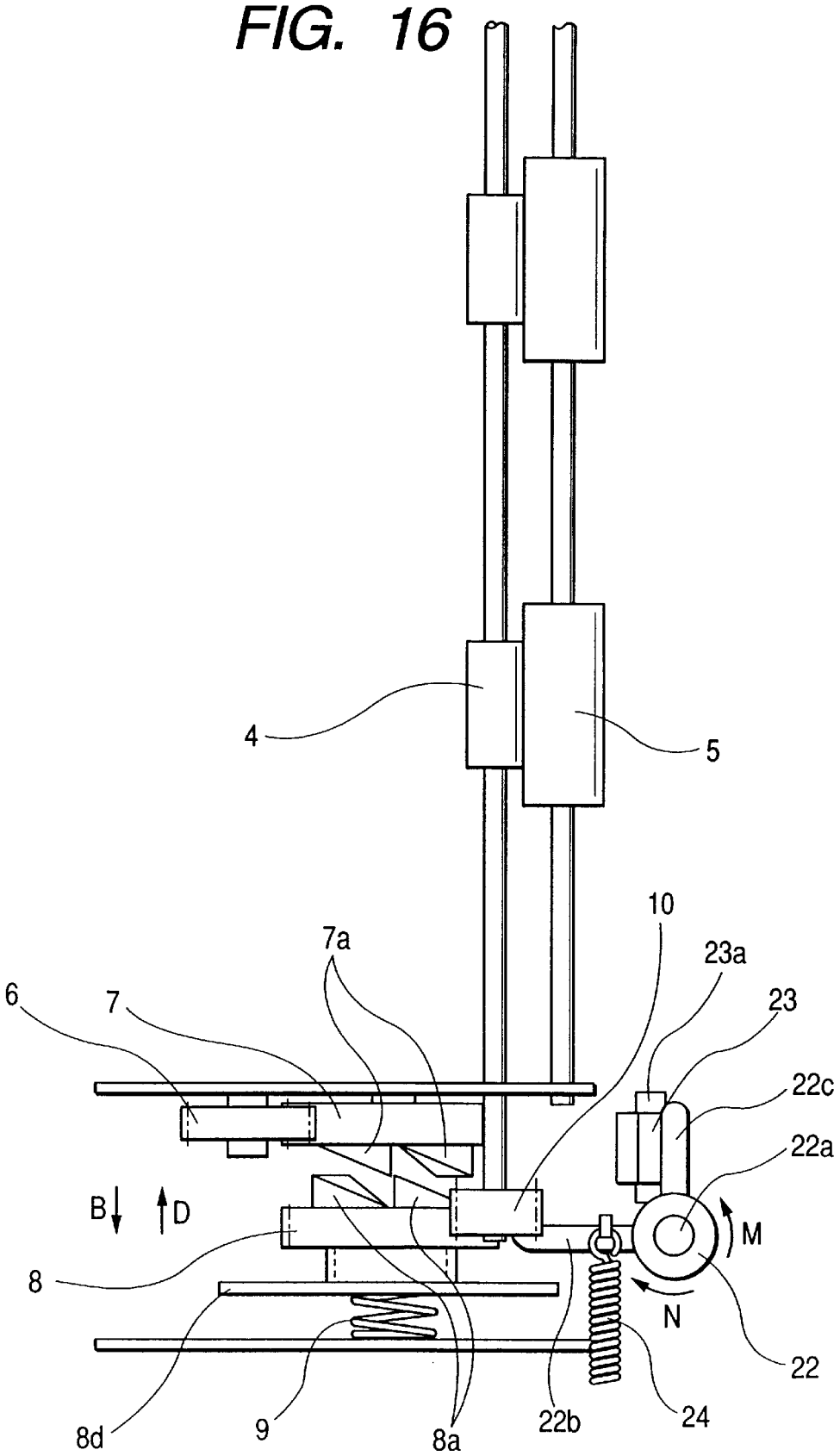

Firstly, when the sheet material S1 is pulled out in the direction of arrow J with the feeding cassette 2 remaining inserted in the main body, as in the above-described first embodiment, the output gear 8 is moved to its position shown in FIG. 16 against the biasing force of the biasing means 9, as shown in FIG. 16. Here, the output gear 8 is rotated in the direction of arrow F and it becomes possible to pull out the sheet material S1 with a small pulling-out force without receiving the force of the main motor or other driving system.

Secondly, when the sheet material S1 is pulled out in the direction of arrow J or K with the feeding cassette 2 remaining pulled out of the image forming apparatus 1, the output gear 8 is moved to the position shown in FIGS. 12 and 13, as described above, and it is separate from the input gear 7. Therefore, it becomes possible to pull out the sheet material S1 without receiving the force of the main motor or other driving system.

As in the present embodiment 3, by providing a projection is on the sheet cassette, the treatability of the jam of the sheet material remaining in the body of the image forming apparatus 1 is improved and the sheet material can be reliably removed. Thus, the trouble in conveyance due to a sheet material remaining in the image forming apparatus 1 after the jam has been dealt with can be prevented.

Figure 17:
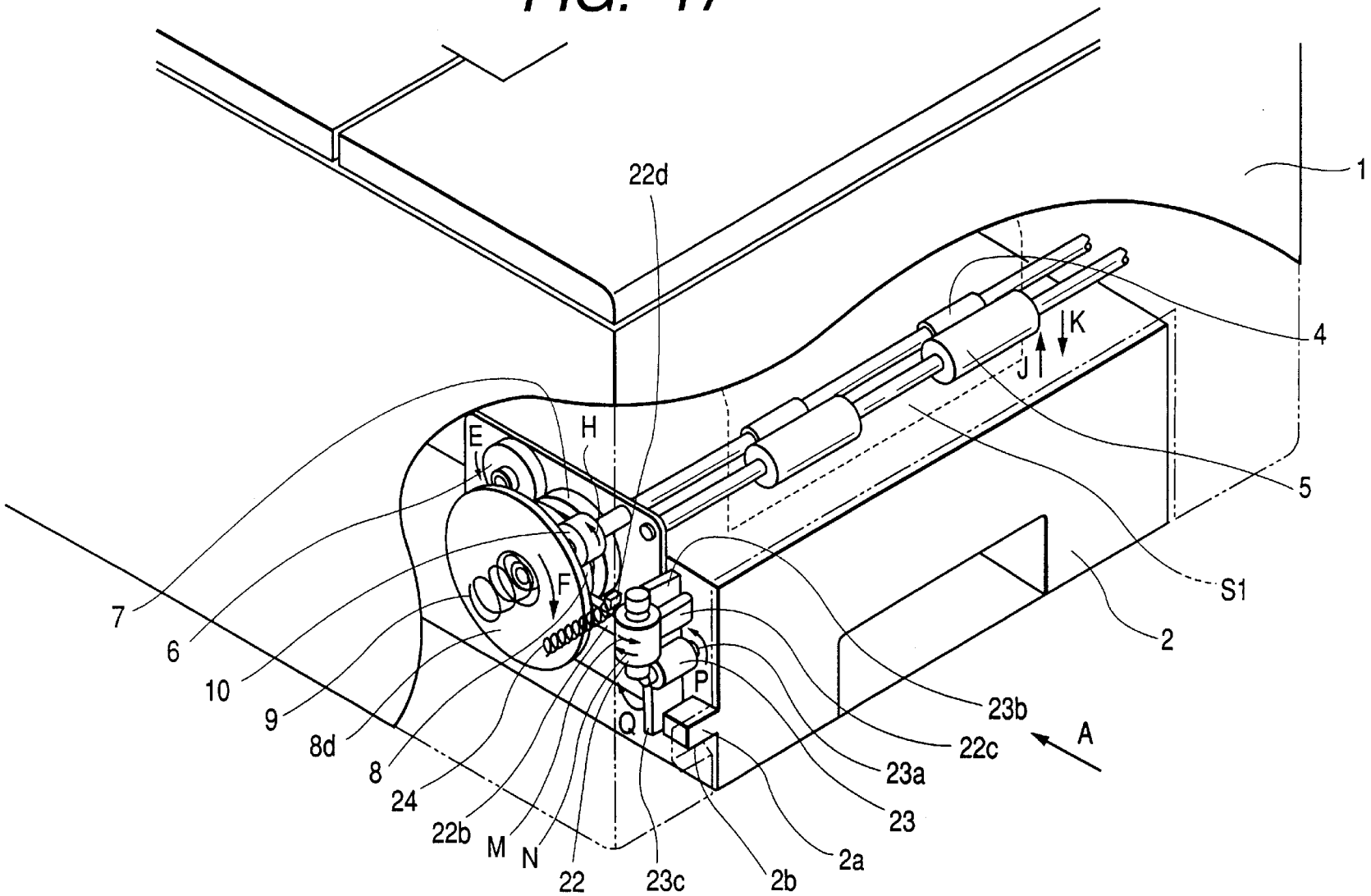
FIGS. 17 and 18 are fragmentary perspective views of an image forming apparatus provided with a sheet material conveying apparatus according to a fourth embodiment of the present invention.
Figure 18:
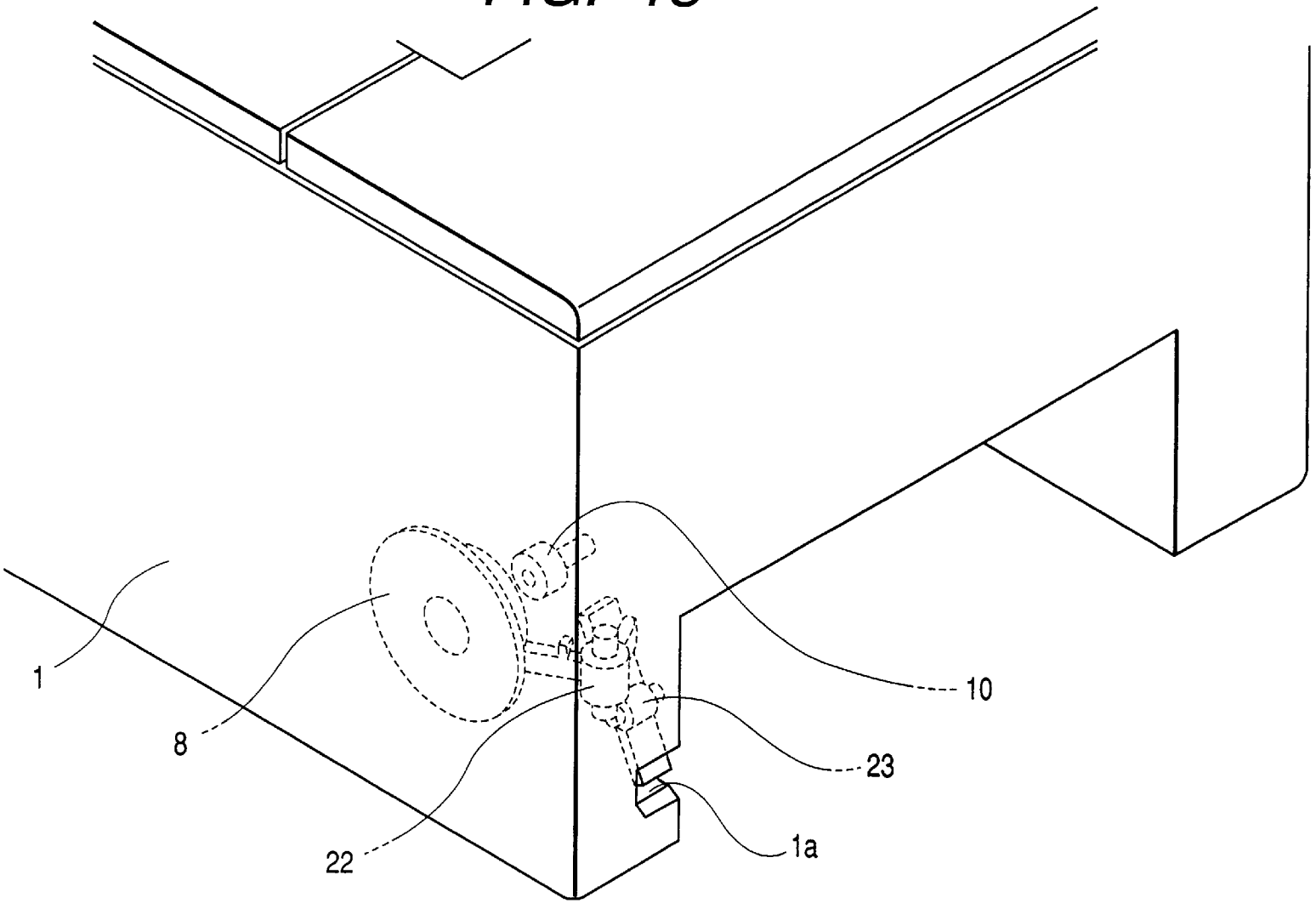

FIGS. 17 and 18 show a fourth embodiment of the present invention, in which the projection shown in the above-described third embodiment performs also as the positioning function when positioning the sheet cassette in the main body. In the other points, the construction and action of the present embodiment are the same as those of the first embodiment, so the same constituent portions are given the same reference characters and need not be described.

In FIG. 18, this image forming apparatus 1 is provided with a flat portion 1*a* near a cassette inserting portion. A feeding cassette 2 is provided with a projected portion 2*a* on a side surface thereof, and has a flat portion 2*b* on the underside of this projected portion 2*a*.

When the feeding cassette 2 is inserted into the image forming apparatus 1 in the direction of arrow A, the flat portion 2*b* of the feeding cassette 2 rides onto the flat portion 1*a* of the image forming apparatus 1, so that the vertical positioning of the feeding cassette 2 with respect to the image forming apparatus 1 is done. The projected portion 2*a* of the feeding cassette 2 pushes the second arm portion 24 of the second lever 23 to thereby perform the same operation as that of the above-described third embodiment.

By adopting the construction as shown in the present embodiment 4, the treatability of the jam of any sheet material remaining in the body of the image forming apparatus 1 is improved, and the sheet material can be reliably removed. Therefore, any trouble in conveyance due to a sheet material remaining in the image forming apparatus 1 after the jam has been dealt with can be prevented. Also, the projected portion 2*a* of the feeding cassette 2 serves also as the vertical positioning member for the feeding cassette 2, so that the accurate vertical positioning of the feeding cassette becomes possible, and at the same time the cost can be reduced.

Figure 19:
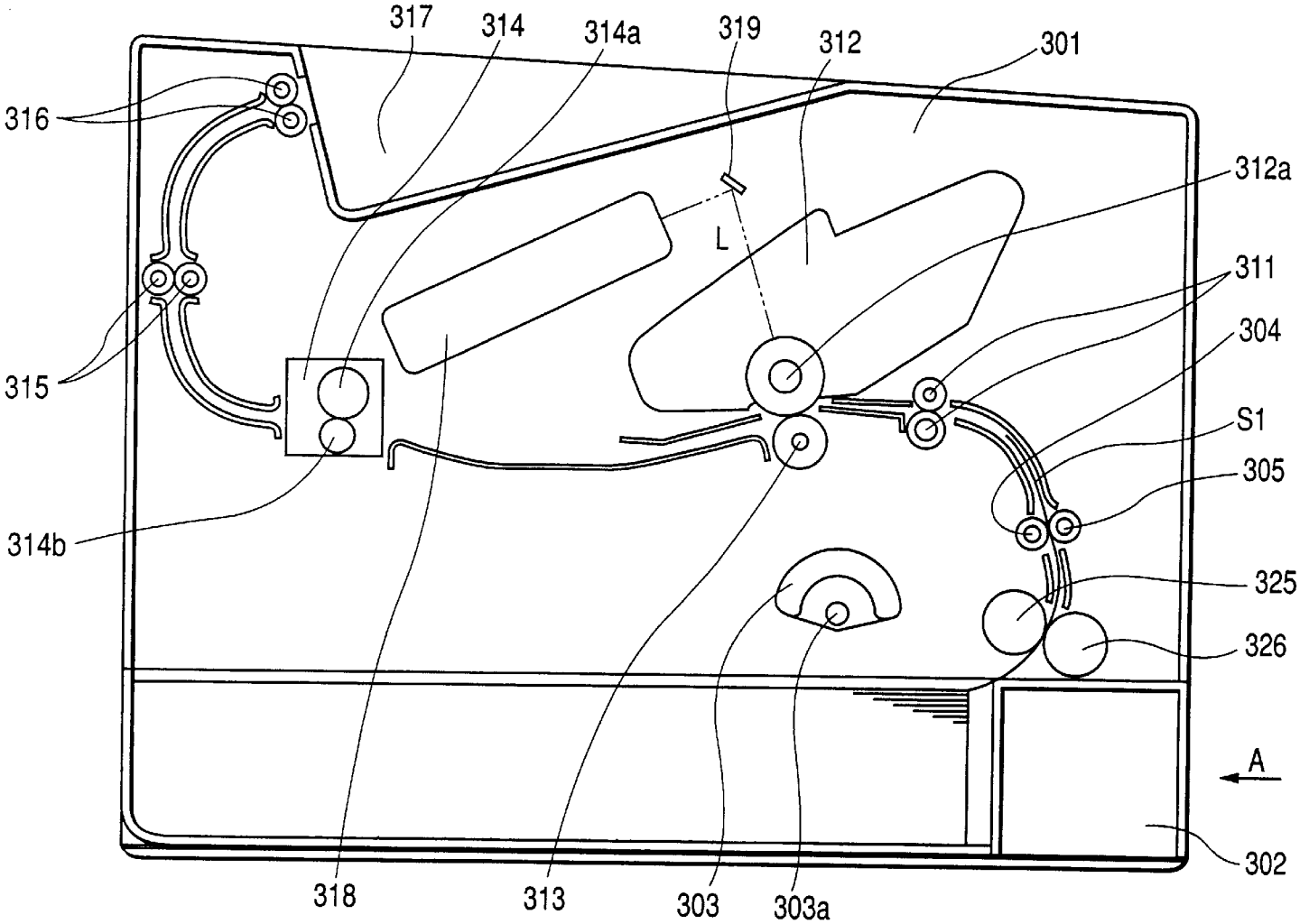
FIG. 19 is a front view of an image forming apparatus according to a fifth embodiment of the present invention.
Figure 20:
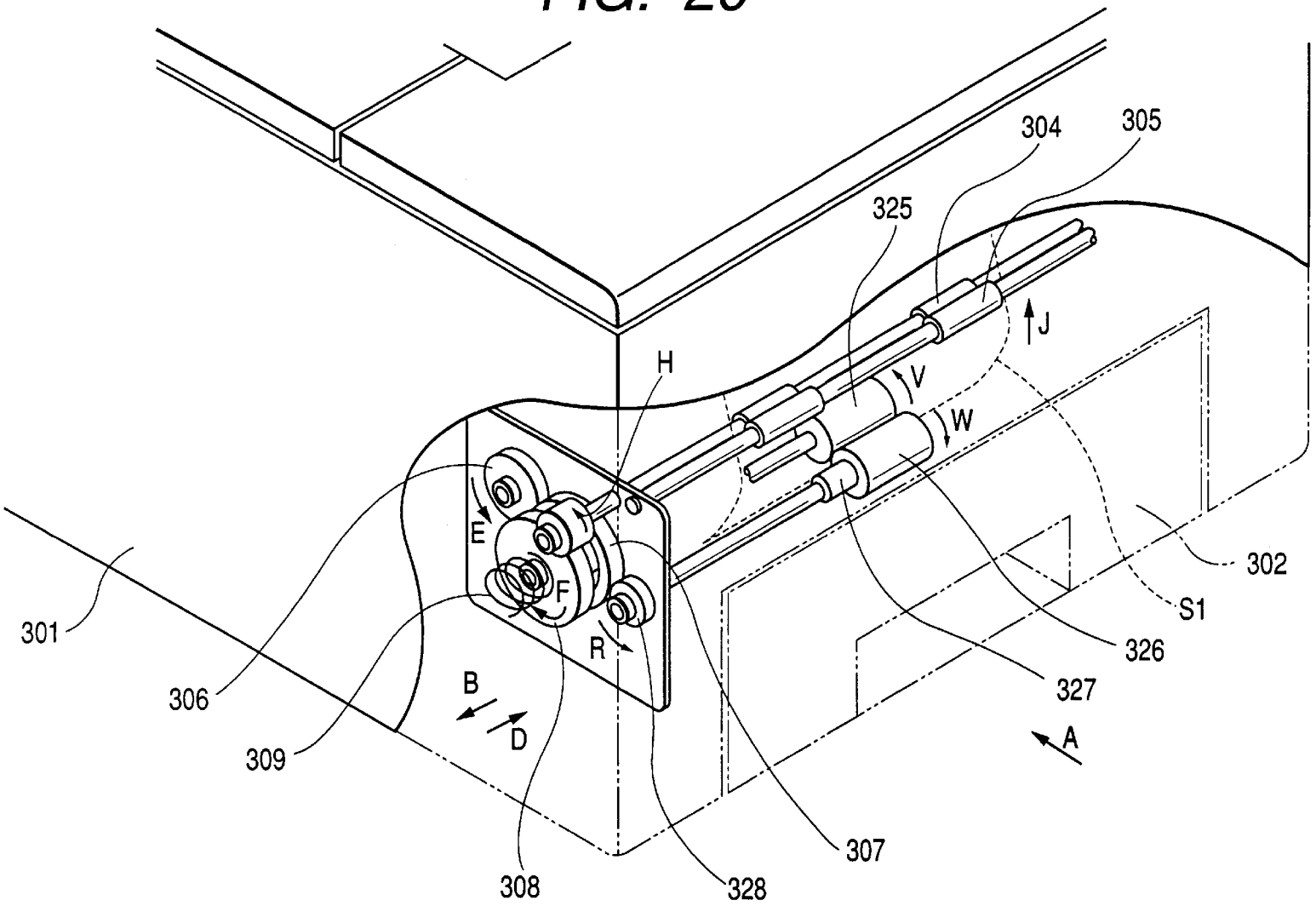
FIGS. 20 and 21 are perspective views of the apparatus of FIG. 19.
Figure 21:
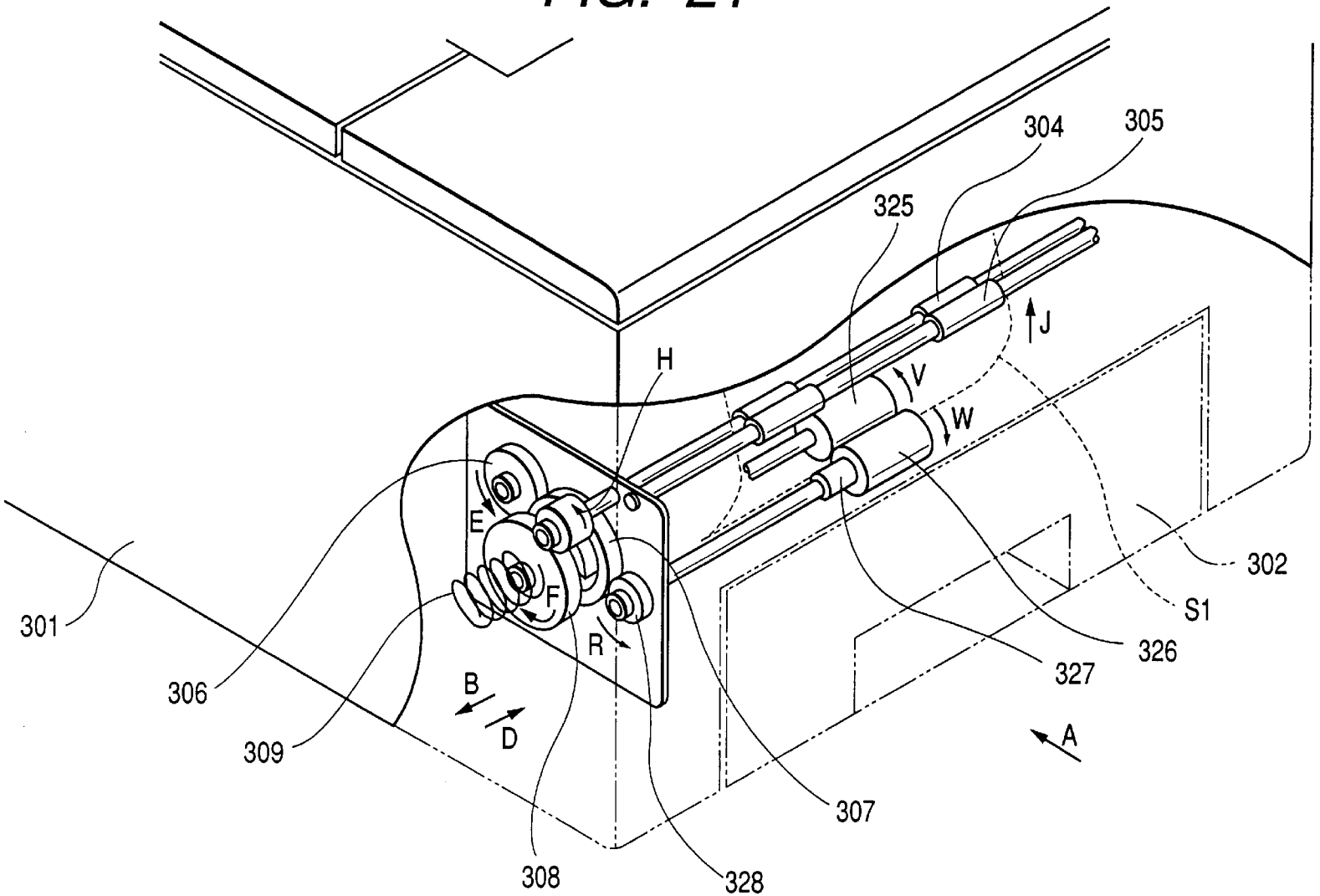
Figure 22:
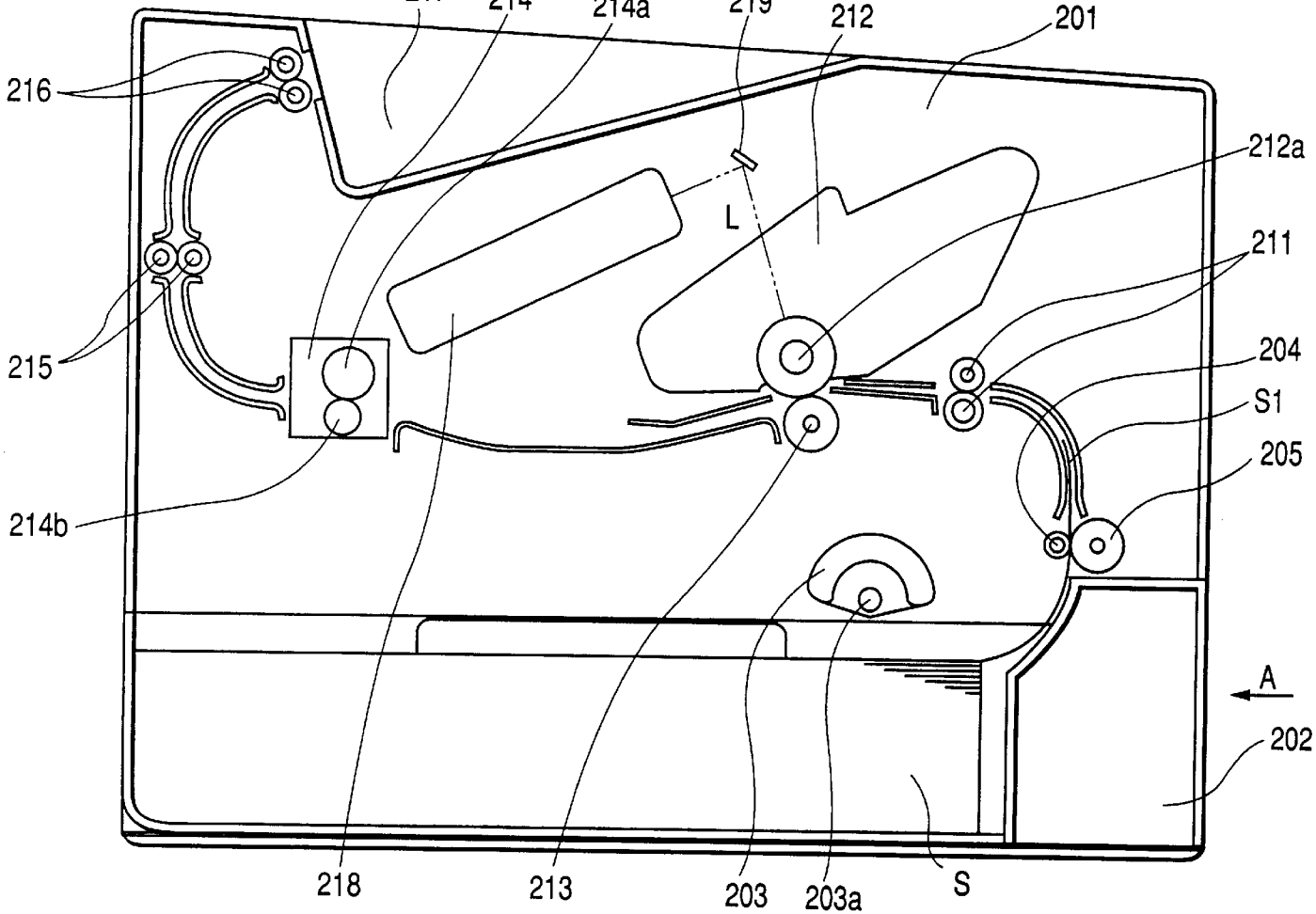
FIG. 22 PRIOR ART
FIG. 22 is a schematic cross-sectional view of an image forming apparatus according to the first prior art.
Figure 23:
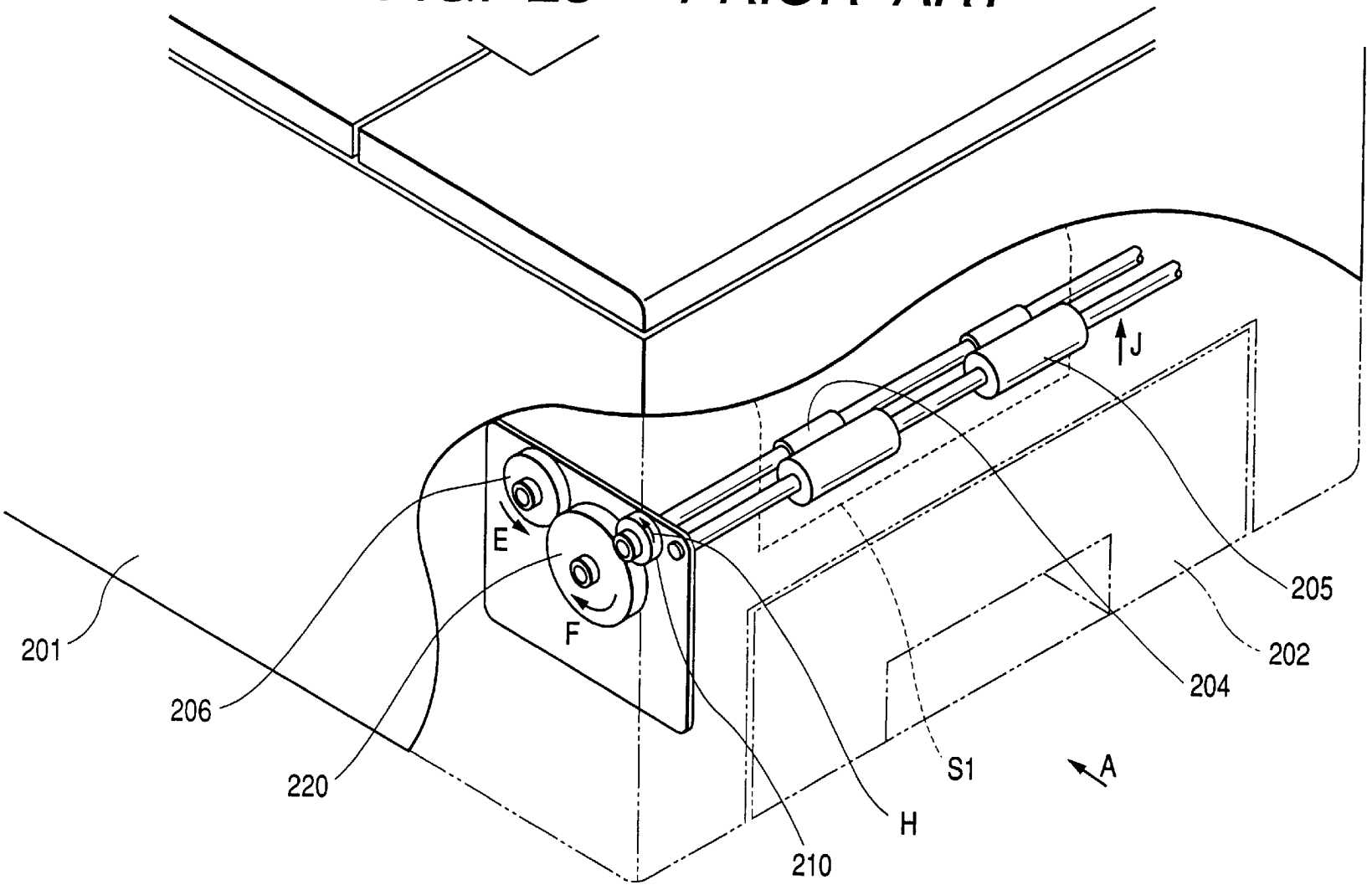
FIG. 23 PRIOR ART
FIG. 23 is a fragmentary perspective view of the apparatus of FIG. 22.

In FIGS. 19 to 21, the feed roller 25 and the retard roller 26 cooperate to construct the nip therebetween. The feed roller 25 is rotated in the direction shown by the arrow V by the driving means (not shown), and the retard roller 26 is connected to the retard roller driving gear 28 connected to the input gear 7 via the torque limiter 27. Rotation of the drive input gear 6 in the direction shown by the arrow E is transmitted to the retard roller driving gear 28 in the direction shown by he arrow R via the input gear 7, and then transmitted to the retard roller 26 via the torque limiter 27.

When only one sheet material S1 is pulled out from the cassette by the sheet supply roller 3, the retard roller 26 receives the rotational force in the direction shown by the arrow W from the sheet material S1 which is further fed by the feed roller 25. The torque limiter 27 does not transmit the drive force but generates the shipping therein when the torque over than the predetermined value is applied thereto, so the retard roller 26 rotates in the direction shown by the arrow W against the drive force of the retard roller driving gear 28 in the direction shown by the arrow R.

When the plural, overlapped sheet materials S1 are fed, he rotational force in the direction shown by the arrow W applied from the sheet material S1 to the retard roller 26 is decreased due to the shipping between the sheet materials. The torque limiter 27 transmits the driving force of the retard roller driving gear 28 in the direction shown by the arrow R to the retard roller 26 without generating the shipping therein, so that the sheet material located at the side of retard roller 26 is pushed back toward the cassette 2.

By constructing the apparatus as mentioned above, when the plural sheet materials are entered into the nip between the feed roller 25 and the retard roller 26, only the uppermost sheet material is conveyed. Another constructions are same as that in the first embodiment 1.

Figure 24:
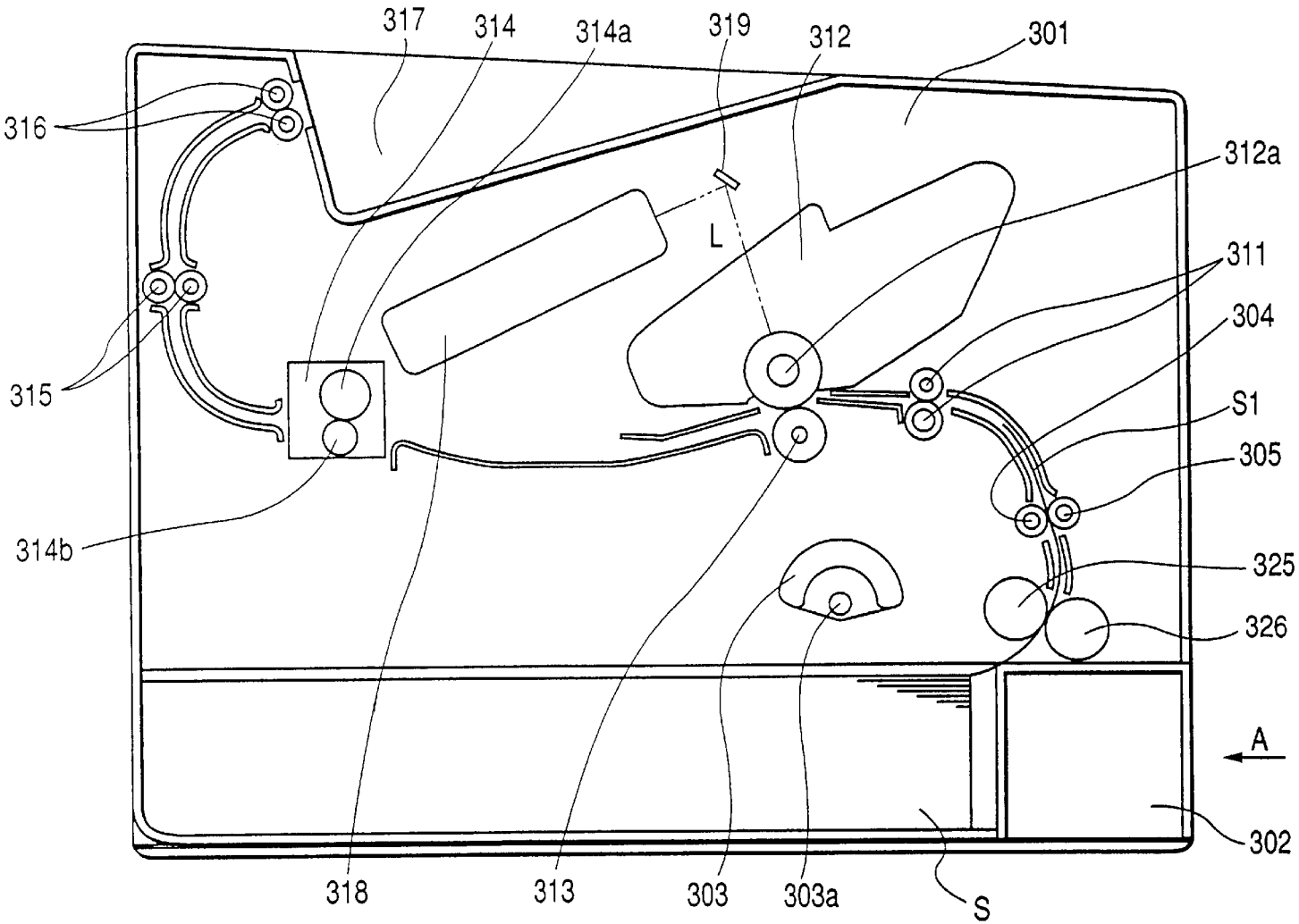
FIG. 24 PRIOR ART
FIG. 24 is a cross-sectional view of an image forming apparatus according to the second prior art.
Figure 25:
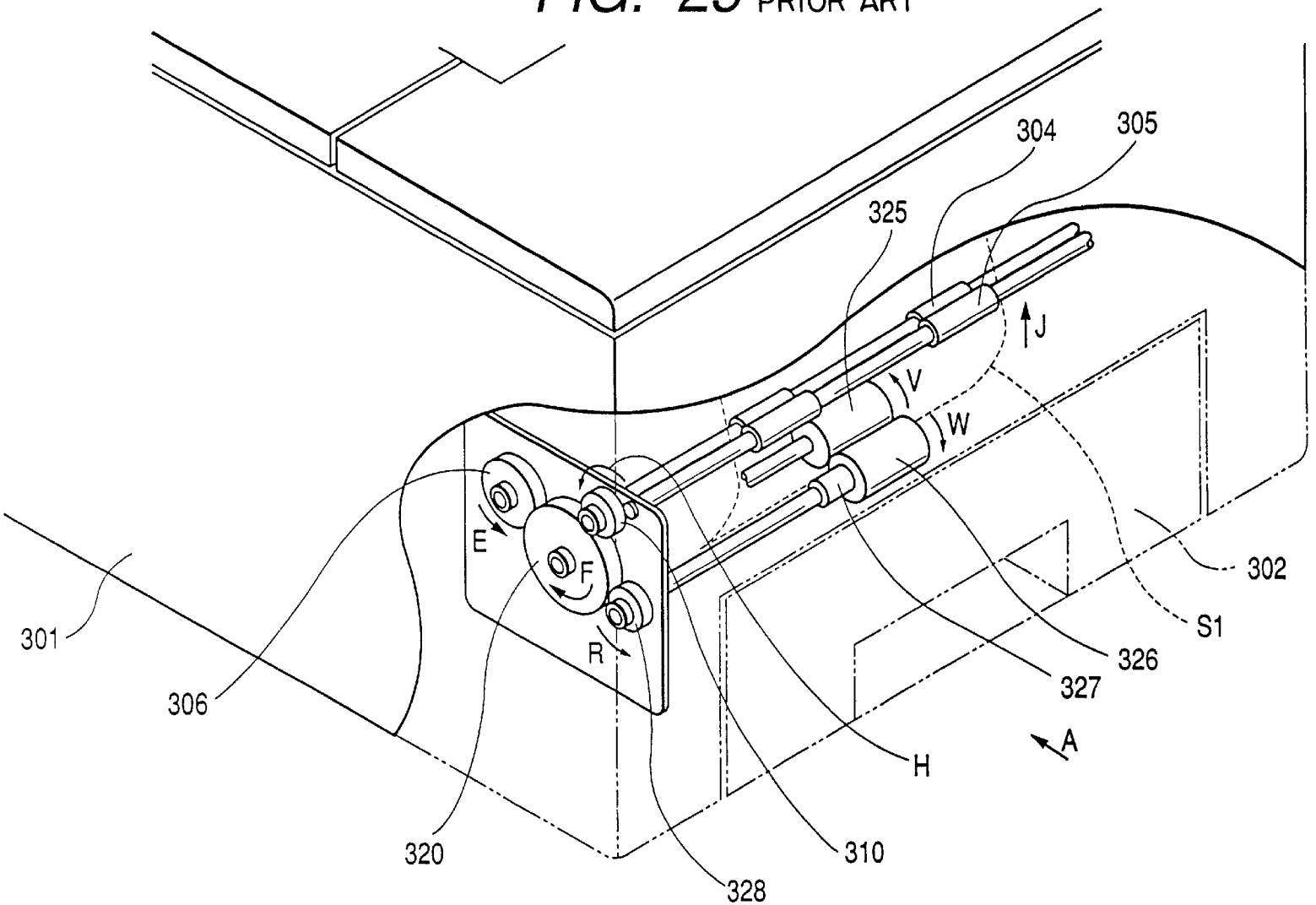
FIG. 25 PRIOR ART
FIG. 25 is a fragmentary perspective view of the apparatus of FIG. 24.

FIGS. 19 to 21 show embodiment 5 of the present invention, in which portions common to those in the second example of the prior art (FIGS. 24 and 25) are designated by corresponding reference numerals.

There is a case where as shown in FIGS. 20 and 21, a sheet material S1 is located at the nip between a conveying roller 304 and a pinch roller 305, and the nip between a feed roller 325 and a retard roller 326, when the image forming apparatus 301 is stopped due to jam or other trouble. At this time, the user performs the work of pulling out the sheet material S1 in the direction of arrow J to deal with the jam. In this case, as in embodiment 1, an output gear 308 is moved to the position shown in FIG. 21, and therefore, no pressing force acts between the conveying roller 304 and the pinch roller 305, and between the feed roller 325 and the retard roller 326.

Here, the rotational force in the direction shown by the arrow H is applied from the pulling-out sheet material to the driving gear 10 via the convey roller 25, so the output gear 8 meshed with the gear 10 is rotated in the direction shown by the arrow F. Similar to the first embodiment 1, when the output gear 8 is moved to the position shown in FIG. 21, the cam member 8*a* rides over the top portion at the cam member 7*a* of the input gear 7. As the result, the output gear 8 is idelly rotated not to transmit rotation to the input gear 7 and the retard roller driving gear 28. For this reason, different from in the second prior art, there is no need to generate the shipping in the torque limiter 27 to rotate the retard roller 26 in the direction shown by the arrow W against the driving force of the retard roller driving gear 28 in the direction shown by the arrow R, so that the sheet can be pulled out by the small force.

By adopting the construction as shown in this embodiment 5, the treatability of the sheet material S1 remaining in the main body of the image forming apparatus 301 during jam is improved. At the same time, it becomes possible to prevent any trouble in conveyance due to the sheet material S1 remaining in the image forming apparatus 301 after the jam has been dealt with.

What is claimed is:

1. A sheet material conveying apparatus comprising:

a sheet cassette for containing sheet materials;

conveying means for conveying the sheet material fed out from said sheet cassette;

a first gear connected with a driving source;

a second gear connected with said conveying means, for transmitting a drive force of said driving source from said first gear to said conveying means by connecting with said first gear; and a pivotally movable member for pivotally moving when said sheet cassette is pulled out from a predetermined position of said apparatus so that said first gear and said second gear are disconnected;

wherein said first gear and said second gear are disconnected, thereby a rotation force is not transmitted to said first gear when a driving force is imparted on said conveying means to rotate said second gear, and wherein said pivotally movable member rotates while abutting against said sheet cassette when said sheet cassette is attached at said predetermined position so that said first gear and said second gear are connected.

2. A sheet material conveying apparatus according to claim 1, wherein said first gear and said second gear are disconnected when a driving force in the sheet material conveying direction is imparted to said conveying means.

3. A sheet material conveying apparatus according to claim 1 or 2, wherein when said first gear is rotated, it is connected to said second gear to transmit the rotational force to said second gear, and when said second gear is rotatively driven, it is disconnected from the first gear and a rotational force is not transmitted to said first gear.

4. A sheet material conveying apparatus according to claim 3, further comprising biasing means for biasing said second gear in a direction to push against said first gear, wherein said first gear and said second gear are provided with projections having engagement surfaces engaged with each other and slide surfaces relatively sliding, and when said first gear is rotated in a predetermined direction, the engagement surfaces of said both projections are engaged with each other to connect said first gear and said second gear, and when said second gear is rotated in a predetermined direction, the slide surfaces of said both projections slide relative to each other to move said second gear away from said first gear against the biasing force of said biasing means so as to disconnect said first gear and said second gear.

5. A sheet material conveying apparatus comprising:

a sheet cassette for containing sheet materials;

a conveying roller for conveying the sheet material fed out from said sheet cassette;

a first gear connected with a driving source;

a second gear connected with said conveying roller, for transmitting a drive force of said driving source from said first gear to said conveying roller by connecting with said first gear; and a pivotally movable member for pivotally moving when said sheet cassette is pulled out from a predetermined position of said apparatus so that said first gear and said second gear are disconnected;

wherein said first gear and said second gear are disconnected, thereby a rotation force is not transmitted to said first gear when the driving force is imparted on said conveying roller to rotate said second gear, and wherein said pivotally movable member rotates while abutting against said sheet cassette when said sheet cassette is attached at said predetermined position so that said first gear and said second gear are connected.

6. A sheet conveying apparatus, comprising:

a sheet cassette for containing sheet materials;

a conveying roller for conveying the sheet material fed out from said sheet cassette;

a first gear connected with a driving source;

a second gear connected with said conveying roller, for transmitting a drive force of said driving source from said first gear to said conveying roller by connecting with said first gear;

a pivotally movable member for pivotally moving when said sheet cassette is pulled out from a predetermined position of said apparatus so that said first gear and said second gear are disconnected, and image forming means for forming an image on the sheet material conveyed by said conveying roller;

wherein said first gear and said second gear are disconnected, thereby a rotation force is not transmitted to said first gear when the driving force is imparted on said conveying roller to rotate said second gear, and wherein said pivotally movable member rotates while abutting against said sheet cassette when said sheet cassette is attached at said predetermined position so that said first gear and said second gear are connected.

7. A sheet conveying apparatus, comprising:

a sheet cassette for containing sheets;

a supply roller for taking out the sheet from said sheet cassette;

a feed roller for feeding the sheet taken out by said supply roller;

a retard roller nipping the sheet by cooperating with said feed roller and applying a convey force opposite to that of said feed roller to the sheet;

a convey roller for conveying the sheet fed by said feed roller in a predetermined conveying direction, wherein a drive force of said convey roller is transmitted to said retard roller via a torque limiter;

a first gear connected with a drive source;

a second gear connected with said convey roller for transmitting a drive force of said driving source from said first gear to said convey roller by connecting with said first gear; and a pivotally movable member for pivotally moving when said sheet cassette is pulled out from a predetermined position of said apparatus so that said first gear and said second gear are disconnected, wherein said first gear and said second gear are disconnected, thereby a rotational force is not transmitted to said first gear when a driving force is imparted on said convey roller to rotate said second gear, and wherein said pivotally movable member rotates while abutting against said sheet cassette when said sheet cassette is attached at said predetermined position so that said first gear and said second gear are connected.

* * * * *

UNITED STATES PATENT AND TRADEMARK OFFICE

CERTIFICATE OF CORRECTION

PATENT NO. : 6,578,840 B1
DATED : June 17, 2003
INVENTOR(S) : Kazuhide Kudo

It is certified that error appears in the above-identified patent and that said Letters Patent is hereby corrected as shown below:

Column 3,
Line 54, “and to” should read -- and needs to --.

Column 4,
Line 7, “direction.” should read -- direction, --.

Column 9,
Line 31, “is” should be deleted.

Column 10,
Lines 13 and 25, “he” should read -- the --.
Line 64, “idelly” should read -- ideally --.

Signed and Sealed this

Second Day of December, 2003

JAMES E. ROGAN
*Director of the United States Patent and Trademark Office*